US011779928B2

(12) United States Patent
Parry-Jones et al.

(10) Patent No.: US 11,779,928 B2
(45) Date of Patent: Oct. 10, 2023

(54) USE OF MULTIPLE FILLER FLUIDS IN AN EWOD DEVICE VIA THE USE OF AN ELECTROWETTING GATE

(71) Applicant: Sharp Life Science (EU) Limited, Uxbridge (GB)

(72) Inventors: Lesley Anne Parry-Jones, Uxbridge (GB); Emma Jayne Walton, Uxbridge (GB)

(73) Assignee: Sharp Life Science (EU) Limited, Uxbridge (GB)

( * ) Notice: Subject to any disclaimer, the term of this patent is extended or adjusted under 35 U.S.C. 154(b) by 9 days.

(21) Appl. No.: 17/851,431

(22) Filed: Jun. 28, 2022

(65) Prior Publication Data

US 2022/0323961 A1 Oct. 13, 2022

Related U.S. Application Data

(63) Continuation of application No. 16/504,606, filed on Jul. 8, 2019, now Pat. No. 11,376,597.

(51) Int. Cl.
*B01L 3/00* (2006.01)

(52) U.S. Cl.
CPC ..... *B01L 3/502792* (2013.01); *B01L 3/50273* (2013.01); *B01L 3/502715* (2013.01);
(Continued)

(58) Field of Classification Search
CPC ..... B01L 3/502715; B01L 3/502792; B01L 3/50273; B01L 2400/0427
See application file for complete search history.

(56) References Cited

U.S. PATENT DOCUMENTS 7,163,612 B2 1/2007 Sterling et al.
7,439,014 B1 10/2008 Pamula et al.
(Continued)

FOREIGN PATENT DOCUMENTS

EP 2672260 12/2013
EP 2616854 3/2018
EP 3632565 4/2020

OTHER PUBLICATIONS

Fair, R.B., "Digital microfluids: is a true lab-on-a-chip possible?" Microfluidics and Nanofluidics Jun. 2007, vol. 3, Issue 3, pp. 245-281.

(Continued)

*Primary Examiner* — Caitlyn Mingyun Sun
(74) *Attorney, Agent, or Firm* — Renner, Otto, Boisselle & Sklar, LLP

(57) ABSTRACT

A method of operating an electrowetting on dielectric (EWOD) device performs electrowetting operations on fluids dispensed into the EWOD device, which provides enhanced operation for using multiple non-polar filler fluids. The method of operating includes the steps of: dispensing a polar fluid source into the EWOD device; performing an electrowetting operation to generate an aqueous barrier from the polar fluid source, wherein the aqueous barrier separates the EWOD device into a first region and a second region that are fluidly separated from each other by the aqueous barrier; inputting a non-polar first filler fluid into the first region; inputting a non-polar second filler fluid into the second region; dispensing a polar liquid droplet into the first region; transferring the polar liquid droplet from the first region to the second region by performing an electrowetting operation to reconfigure the aqueous barrier, and performing an electrowetting operation to move the polar liquid droplet from the first region to the second region through the reconfigured aqueous barrier; and performing an electrowetting operation
(Continued)

to reconstitute the aqueous barrier to fluidly separate the first region from the second region. The method may be performed by an EWOD control system executing program code stored on a non-transitory computer readable medium.

16 Claims, 11 Drawing Sheets

(52) U.S. Cl.
CPC ..... *B01L 2300/02* (2013.01); *B01L 2300/06* (2013.01); *B01L 2300/0645* (2013.01); *B01L 2400/0427* (2013.01)

(56) References Cited

U.S. PATENT DOCUMENTS 8,088,578 B2 * 1/2012 Hua ..... C12Q 1/6848 422/68.1
8,173,000 B1 5/2012 Hadwen et al.
8,653,832 B2 2/2014 Hadwen et al.
8,658,111 B2 * 2/2014 Srinivasan ..... B01L 3/502784 204/600
2011/0083964 A1 * 4/2011 Ulmanella ..... B01L 3/50273 204/643
2013/0109575 A1 5/2013 Kleinschmidt et al.
2017/0056887 A1 3/2017 Hadwen et al.
2017/0076676 A1 3/2017 Hadwen
2018/0059056 A1 3/2018 Taylor et al.
2018/0078934 A1 3/2018 Hadwen et al.
2019/0039072 A1 2/2019 Walton et al.

OTHER PUBLICATIONS

Tao He et al.: "Two-phase microfluidics in electrowetting displays and its effect on optical performance" (Biomicrofluidics 10, 011908 (2016)).
Martel et al.: "Handling of artificial membranes using electrowetting-actuated droplets on a microfluidic device combined with integrated pA-measurements" Mar. 2012; 6(1): 012813-012813-7.

* cited by examiner

USE OF MULTIPLE FILLER FLUIDS IN AN EWOD DEVICE VIA THE USE OF AN ELECTROWETTING GATE

RELATED APPLICATIONS

This application is continuation application of U.S. application Ser. No. 16/504,606 filed on Jul. 8, 2019, the entire disclosure of which is hereby incorporated by reference.

TECHNICAL FIELD

The present invention relates to droplet microfluidic devices, and more specifically to Active Matrix Electrowetting-On-Dielectric (AM-EWOD) devices, and to methods of operating such devices for manipulating multiple filler fluids having different properties to achieve a desired fluid interaction.

BACKGROUND ART

Electrowetting on dielectric (EWOD) is a well-known technique for manipulating droplets of fluid by application of an electric field. Active Matrix EWOD (AM-EWOD) refers to implementation of EWOD in an active matrix array incorporating transistors, for example by using thin film transistors (TFTs). It is thus a candidate technology for digital microfluidics for lab-on-a-chip technology. An introduction to the basic principles of the technology can be found in "Digital microfluidics: is a true lab-on-a-chip possible?", R. B. Fair, Microfluid Nanofluid (2007) 3:245-281).

FIG. 1 is a drawing depicting an exemplary EWOD based microfluidic system. In the example of FIG. 1, the microfluidic system includes a reader 32 and a cartridge 34. The cartridge 34 may contain a microfluidic device, such as an AM-EWOD device 36, as well as (not shown) fluid input ports into the device and an electrical connection as are conventional. The fluid input ports may perform the function of inputting fluid into the AM-EWOD device 36 and generating droplets within the device, for example by dispensing from input reservoirs as controlled by electrowetting. As further detailed below, the microfluidic device includes an electrode array configured to receive the inputted fluid droplets.

The microfluidic system further may include a control system configured to control actuation voltages applied to the electrode array of the microfluidic device to perform manipulation operations to the fluid droplets. For example, the reader 32 may contain such a control system configured as control electronics 38 and a storage device 40 that may store any application software and any data associated with the system. The control electronics 38 may include suitable circuitry and/or processing devices that are configured to carry out various control operations relating to control of the AM-EWOD device 36, such as a CPU, microcontroller or microprocessor.

In the example of FIG. 1, an external sensor module 35 is provided for sensor droplet properties. For example, optical sensors as are known in the art may be employed as external sensors for sensing droplet properties, which may be incorporated into a probe that can be located in proximity to the EWOD device. Suitable optical sensors include camera devices, light sensors, charged coupled devices (CCD) and similar image sensors, and the like. A sensor additionally or alternatively may be configured as internal sensor circuitry incorporated as part of the drive circuitry in each array element. Such sensor circuitry may sense droplet properties by the detection of an electrical property at the array element, such as impedance or capacitance.

FIG. 2 is a drawing depicting additional details of the exemplary AM-EWOD device 36 in a perspective view. The AM-EWOD device 36 has a lower substrate assembly 44 with thin film electronics 46 disposed upon the lower substrate assembly 44. The thin film electronics 46 are arranged to drive array element electrodes 48. A plurality of array element electrodes 48 are arranged in an electrode or element two-dimensional array 50, having N rows by M columns of array elements where N and M may be any integer. A liquid droplet 52 which may include any polar liquid and which typically may be aqueous, is enclosed between the lower substrate 44 and a top substrate 54 separated by a spacer 56, although it will be appreciated that multiple liquid droplets 52 can be present.

FIG. 3 is a drawing depicting a cross section through some of the array elements of the exemplary AM-EWOD 36 device of FIG. 2. In the portion of the AM-EWOD device depicted in FIG. 3, the device includes a pair of the array element electrodes 48A and 48B that are shown in cross section that may be utilized in the electrode or element array 50 of the AM-EWOD device 36 of FIG. 3. The AM-EWOD device 36 further incorporates the thin-film electronics 46 disposed on the lower substrate 44, which is separated from the upper substrate 54 by the spacer 56. The uppermost layer of the lower substrate 44 (which may be considered a part of the thin film electronics layer 46) is patterned so that a plurality of the array element electrodes 48 (e.g. specific examples of array element electrodes are 48A and 48B in FIG. 3) are realized. The term element electrode 48 may be taken in what follows to refer both to the physical electrode structure 48 associated with a particular array element, and also to the node of an electrical circuit directly connected to this physical structure. A reference electrode 58 is shown in FIG. 3 disposed upon the top substrate 54, but the reference electrode alternatively may be disposed upon the lower substrate 44 to realize an in-plane reference electrode geometry. The term reference electrode 58 may also be taken in what follows to refer to both or either of the physical electrode structure and also to the node of an electrical circuit directly connected to this physical structure.

In the AM-EWOD device 36, a non-polar fluid 60 (e.g. oil) may be used to occupy the volume not occupied by the liquid droplet 52. An insulator layer 62 may be disposed upon the lower substrate 44 that separates the conductive element electrodes 48A and 48B from a first hydrophobic coating 64 upon which the liquid droplet 52 sits with a contact angle 66 represented by 8. The hydrophobic coating is formed from a hydrophobic material (commonly, but not necessarily, a fluoropolymer). On the top substrate 54 is a second hydrophobic coating 68 with which the liquid droplet 52 may come into contact. The reference electrode 58 is interposed between the top substrate 54 and the second hydrophobic coating 68.

The contact angle θ for the liquid droplet is defined as shown in FIG. 3, and is determined by the balancing of the surface tension components between the solid-liquid ($\gamma_{SL}$), liquid-gas ($\gamma_{LG}$) and non-ionic fluid ($\gamma_{SG}$) interfaces, and in the case where no voltages are applied satisfies Young's law, the equation being given by:

$$\cos\theta = \frac{\gamma_{SG} - \gamma_{SL}}{\gamma_{LG}} \quad \text{(equation 1)}$$

In operation, voltages termed the EW drive voltages, (e.g. $V_T$, $V_0$ and $V_{00}$ in FIG. 3) may be externally applied to different electrodes (e.g. reference electrode 58, element electrodes 48A and 48B, respectively). The resulting electrical forces that are set up effectively control the hydrophobicity of the hydrophobic coating 64. By arranging for different EW drive voltages (e.g. $V_0$ and $V_{00}$) to be applied to different element electrodes (e.g. 48A and 48B), the liquid droplet 52 may be moved in the lateral plane between the two substrates, for example from being positioned over 48A to being positioned over 48B.

FIG. 4A shows a circuit representation of the electrical load 70A between the element electrode 48 and the reference electrode 58 in the case when a liquid droplet 52 is present. The liquid droplet 52 can usually be modeled as a resistor and capacitor in parallel. Typically, the resistance of the droplet will be relatively low (e.g. if the droplet contains ions) and the capacitance of the droplet will be relatively high (e.g. because the relative permittivity of polar liquids is relatively high, e.g. ~80 if the liquid droplet is aqueous). In many situations the droplet resistance is relatively small, such that at the frequencies of interest for electrowetting, the liquid droplet 52 may function effectively as an electrical short circuit. The hydrophobic coatings 64 and 68 have electrical characteristics that may be modelled as capacitors, and the insulator 62 may also be modelled as a capacitor. The overall impedance between the element electrode 48 and the reference electrode 58 may be approximated by a capacitor whose value is typically dominated by the contribution of the insulator 62 and hydrophobic coatings 64 and 68 contributions, and which for typical layer thicknesses and materials may be on the order of a pico-Farad in value.

FIG. 4B shows a circuit representation of the electrical load 70B between the element electrode 48 and the reference electrode 58 in the case when no liquid droplet is present. In this case the liquid droplet components are replaced by a capacitor representing the capacitance of the non-polar fluid 60 which occupies the space between the top and lower substrates. In this case the overall impedance between the element electrode 48 and the reference electrode 58 may be approximated by a capacitor whose value is dominated by the capacitance of the non-polar fluid and which is typically small, on the order of femto-Farads.

For the purposes of driving and sensing the array elements, the electrical load 70A/70B overall functions in effect as a capacitor, whose value depends on whether a liquid droplet 52 is present or not at a given element electrode 48. In the case where a droplet is present, the capacitance is relatively high (typically of order pico-Farads), whereas if there is no liquid droplet present the capacitance is low (typically of order femto-Farads). If a droplet partially covers a given electrode 48 then the capacitance may approximately represent the extent of coverage of the element electrode 48 by the liquid droplet 52.

U.S. Pat. No. 7,163,612 (Sterling et al., issued Jan. 16, 2007) describes how TFT based thin film electronics may be used to control the addressing of voltage pulses to an EWOD array by using circuit arrangements very similar to those employed in active matrix display technologies. The approach of U.S. Pat. No. 7,163,612 may be termed "Active Matrix Electrowetting on Dielectric" (AM-EWOD). There are several advantages in using TFT based thin film electronics to control an EWOD array, namely:

- Electronic driver circuits can be integrated onto the lower substrate.
- TFT-based thin film electronics are well suited to the AM-EWOD application. They are cheap to produce so that relatively large substrate areas can be produced at relatively low cost.
- TFTs fabricated in standard processes can be designed to operate at much higher voltages than transistors fabricated in standard CMOS processes. This is significant since many EWOD technologies require electrowetting voltages in excess of 20V to be applied.

FIG. 5 is a drawing depicting an exemplary arrangement of thin film electronics 46 in the exemplary AM-EWOD device 36 of FIG. 2. The thin film electronics 46 is located upon the lower substrate 44. Each array element 51 of the array of elements 50 contains an array element circuit 72 for controlling the electrode potential of a corresponding element electrode 48. Integrated row driver 74 and column driver 76 circuits are also implemented in thin film electronics 46 to supply control signals to the array element circuit 72. The array element circuit 72 may also contain a sensor capability for detecting the presence or absence of a liquid droplet in the location of the array element. Integrated sensor row addressing 78 and column detection circuits 80 may further be implemented in thin film electronics for the addressing and readout of the sensor circuitry in each array element.

A serial interface 82 may also be provided to process a serial input data stream and facilitate the programming of the required voltages to the element electrodes 48 in the array 50. A voltage supply interface 84 provides the corresponding supply voltages, top substrate drive voltages, and other requisite voltage inputs as further described herein. A number of connecting wires 86 between the lower substrate 44 and external control electronics, power supplies and any other components can be made relatively few, even for large array sizes. Optionally, the serial data input may be partially parallelized. For example, if two data input lines are used the first may supply data for columns 1 to X/2, and the second for columns (1+X/2) to M with minor modifications to the column driver circuits 76. In this way the rate at which data can be programmed to the array is increased, which is a standard technique used in liquid crystal display driving circuitry.

FIG. 6 is a drawing depicting an exemplary arrangement of the array element circuit 72 present in each array element 51, which may be used as part of the thin film electronics of FIG. 5. The array element circuit 72 may contain an actuation circuit 88, having inputs ENABLE, DATA and ACTUATE, and an output which is connected to an element electrode 48. The array element circuit 72 also may contain a droplet sensing circuit 90, which may be in electrical communication with the element electrode 48. Typically, the read-out of the droplet sensing circuit 90 may be controlled by one or more addressing lines (e.g. RW) that may be common to elements in the same row of the array, and may also have one or more outputs, e.g. OUT, which may be common to all elements in the same column of the array.

The array element circuit 72 may typically perform the functions of:

(i) Selectively actuating the element electrode 48 by supplying a voltage to the array element electrode. Accordingly, any liquid droplet present at the array element 51 may be actuated or de-actuated by the electro-wetting effect.

(ii) Sensing the presence or absence of a liquid droplet at the location of the array element 51. The means of sensing may be capacitive or impedance, optical, thermal or some other means. Capacitive or impedance sensing may be employed conveniently and effectively using an integrated impedance sensor circuit as part of the array element circuitry.

Various methods of controlling an AM-EWOD device to sense droplets and perform desired droplet manipulations have been described. For example, US 2017/0056887 (Hadwen et al., published Mar. 2, 2017) describes the use of capacitance detection to sense dynamic properties of reagents as a way for determining the output of an assay. Such disclosure incorporates an integrated impedance sensor circuit that is incorporated specifically into the array element circuitry of each array element. Accordingly, attempts have been made to optimize integrated impedance sensing circuitry into the array element structure, and in particular as part of the array element circuitry. Examples of AM-EWOD devices having integrated actuation and sensing circuits are described, for example, in Applicant's commonly assigned patent documents as follows: U.S. Pat. No. 8,653,832 (Hadwen et al., issued Fe. 18, 2014); US 2018/0078934 (Hadwen et al., published Mar. 22, 2018); US 2017/0076676 (Hadwen, published Mar. 16, 2017); and U.S. Pat. No. 8,173,000 (Hadwen et al., issued May 8, 2012). The enhanced method of operation described in the current application may be employed in connection with any suitable array element circuitry.

The description above demonstrates advantages of using a TFT configuration to make the backplane of the AM-EWOD device. This permits a large area for droplet manipulations that is achieved at relatively low cost. Example materials for manufacturing TFT based AM-EWOD devices could be any suitable materials for manufacturing active matrix displays, including for example low temperature polysilicon (LTPS), amorphous-silicon (a-Si), and indium gallium zinc oxide (IGZO), and any suitable related manufacturing processes may be employed. Even with the advantages of TFT based AM-EWOD devices, analytical challenges remain. In particular, it may be desirable to control or dictate the interface between a polar, aqueous liquid droplet and the non-polar fluid to achieve a desired fluidic operation or interaction.

EP 2 616 854 (Mallard et al., published Jul. 24, 2013) describes certain "desirable" characteristics of a non-polar fluid that might be utilized within an EWOD device to achieve a desired fluidic interaction. Such patent document, however, does not teach or suggest any ways of manipulating multiple non-polar fluids to achieve a desired fluidic interaction at different stages or stages of a multi-step reaction protocol.

Tao He et al. (BIOMICROFLUIDICS 10, 011908 (2016)) describe two-phase microfluidics in electrowetting displays and relates effects on optical performance. The article discloses a display device that comprises an array of micropixels having walls that separate the pixels. The article discloses: "The pixels were 150 um×150 um with grid height and width about 6 and 15 um, respectively. Coloured oil and conductive liquid were then filled and sealed with a cover plate to form an electrowetting display device." As a microfluidic display device, there is nothing in He et al. to suggest operations that include transferring fluid from one pixel to another, as such operation would not be useful in a display device.

U.S. Pat. No. 8,658,111 (Srinivasan et al., issued Feb. 24, 2004) describes an EWOD device divided spatially into multiple zones that are designed to separate different oils within their respective zones, and a means of moving droplets between the zones. The difference zones are generated employing different actuation voltages to different portions of the device.

Applicant has previously attempted to control fluidic interactions through the use of electrowetting forces to generate reconfigurable barrier regions formed of a polar fluid. The barrier regions, for example, may control the flow of filler fluids (oil) that are inputted into the device, or may separate regions of the device for use in different reaction steps. Examples of such operations are described in Applicant's application Ser. No. 15/759,685 filed on Mar. 13, 2018, and application Ser. No. 16/147,964 filed Oct. 1, 2018, the contents of which are incorporated here by reference.

Liquid droplets to which manipulation operations are to be performed are typically polar, aqueous fluids that are commonly surrounded by a non-polar filler fluid (typically an oil) within which the polar liquid droplets are immiscible. Examples of the non-polar filler fluid include (without limitation) silicone oil, fluorosilicone oil, pentane, hexane, octane, decane, dodecane, pentadecane, hexadecane, which generally may be referred to as oil. Although less typical, in certain applications the filler fluid may simply be air or another gas.

A non-polar oil filler fluid may perform various functions, which may include (without limitation) the following. The oil filler fluid lowers the surface tension around the boundaries of the polar liquid droplets (as compared to having the droplets in air) so that the polar fluids can be inputted into the device more readily and/or be manipulated more easily by electrowetting operations. In some applications, a surfactant may be employed to enhance the lowering of the surface tension of the polar liquid droplets. When used, the surfactant may be dissolved in the filler fluid (although in some applications the surfactant alternatively may be dissolved in the polar fluid). The filler fluid also prevents the polar liquid droplets from reducing in size due to evaporation.

Attempts have been made to perform EWOD operations using multiple and different filler fluids for different reactions or different phases of a reaction protocol on a single EWOD device. For example, U.S. Pat. No. 7,439,014 (Pamula et al., issued Oct. 21, 2008) describes the sequential use of different filler fluids. To avoid cross-mixing or contamination, the differ filler fluids are inputted into separate physical chambers that are separated by walls or other comparable structural barriers. The need for structural barriers built onto the EWOD device limits spatial flexibility for performing reaction steps.

SUMMARY OF INVENTION

There is a need in the art for improved systems and methods of operating an EWOD or AM-EWOD device that can accommodate multiple filler fluids having different characteristics that may be employed within a single EWOD device. The requirements of the filler fluid may differ depending upon the particular application for which the EWOD device is to be used. Properties or characteristics of a filler fluid also may need to be different at different stages within a specific assay, sample preparation, or reaction protocol that is to be performed within an EWOD device. The present invention provides a system and methods that accommodate the need to use filler fluids of different properties or characteristics by facilitating the use of multiple and different filler fluids within a single EWOD device.

In exemplary embodiments, a polar fluid source may be dispensed into an EWOD device array by any suitable mechanism. Electrowetting forces are employed to modify the polar fluid to form an aqueous barrier across the EWOD device array that separates the EWOD device array into fluidly separated regions or zones. First and second non-polar filler fluids are then dispensed respectively into the EWOD device on opposites sides of the aqueous barrier, such that the aqueous barrier prevents intermixing between the filler fluids. Additional polar fluid constituting one or more sample and/or reagent polar liquid droplets are dispensed onto the EWOD device. The liquid droplets may be transferred between the different device regions having the different polar fluids by employing electrowetting operations to: reconfigure the aqueous barrier, such as by opening a passage in the aqueous barrier, transfer one or more liquid droplets through the reconfigured aqueous barrier from a first region to a second region of the EWOD device, and reconstituting the aqueous barrier to re-separate the first and second regions. By employing such an aqueous barrier, intermixing of the different filler fluids and any constituents thereof is minimized.

In another embodiment, different polar fluids may be employed sequentially in time. In such device operation, a first non-polar filler fluid is dispensed into an EWOD device, and a polar fluid constituting one or more sample and/or reagent polar liquid droplets are dispensed onto the EWOD device array. Following the performance of any desired droplet manipulation operations, the first filler fluid is extracted while electrowetting forces are applied to the polar liquid droplet(s) to maintain the droplet positioning on the EWOD device array. A second non-polar filler fluid is then dispensed into the EWOD device, again while electrowetting forces are applied to the polar liquid droplet(s) to maintain the droplet positioning on the EWOD device array during the filler fluid exchange.

An aspect of the invention, therefore, is a method of operating an electrowetting on dielectric (EWOD) device that performs electrowetting operations on fluids dispensed into the EWOD device, which provides enhanced operation for using multiple non-polar filler fluids. In exemplary embodiments, the method of operating includes the steps of: dispensing a polar fluid source into the EWOD device; performing an electrowetting operation to generate an aqueous barrier from the polar fluid source, wherein the aqueous barrier separates the EWOD device into a first region and a second region that are fluidly separated from each other by the aqueous barrier; inputting a non-polar first filler fluid into the first region; inputting a non-polar second filler fluid into the second region; dispensing a polar liquid droplet into the first region; transferring the polar liquid droplet from the first region to the second region by performing an electrowetting operation to reconfigure the aqueous barrier, and performing an electrowetting operation to move the polar liquid droplet from the first region to the second region through the reconfigured aqueous barrier; and performing an electrowetting operation to reconstitute the aqueous barrier to fluidly separate the first region from the second region. The methods of the present invention may be performed by an EWOD control system executing program code stored on a non-transitory computer readable medium.

Reconfiguring the aqueous barrier may include performing an electrowetting operation to open a passage through the aqueous barrier, and reconstituting the aqueous barrier may include performing an electrowetting operation to close the passage. Reconfiguring the aqueous barrier may include forming a double walled section of the aqueous barrier enclosing a third region of the EWOD device that is fluidly separated from the first region and the second region by said double walled section. The polar liquid droplet is then transferred from the first region to the second region through the third region using a double gated transference operation by which passages are formed sequentially through different limbs of the double walled section.

Another method of operating an EWOD device may include the steps of: inputting a non-polar first filler fluid into the EWOD device; dispensing a polar liquid droplet into the EWOD device, wherein the polar liquid droplet is surrounded by the first filler fluid; performing an electrowetting operation to perform a droplet manipulation operation on the polar liquid droplet; extracting the first filler fluid from the EWOD device while actuating a portion of array elements of the EWOD device to maintain a position of the polar liquid droplet within the EWOD device; and inputting a non-polar second filler fluid into the EWOD device while actuating a portion of array elements of the EWOD device to maintain a position of the polar liquid droplet within the EWOD device.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DESCRIPTION OF EMBODIMENTS

Figure 1:
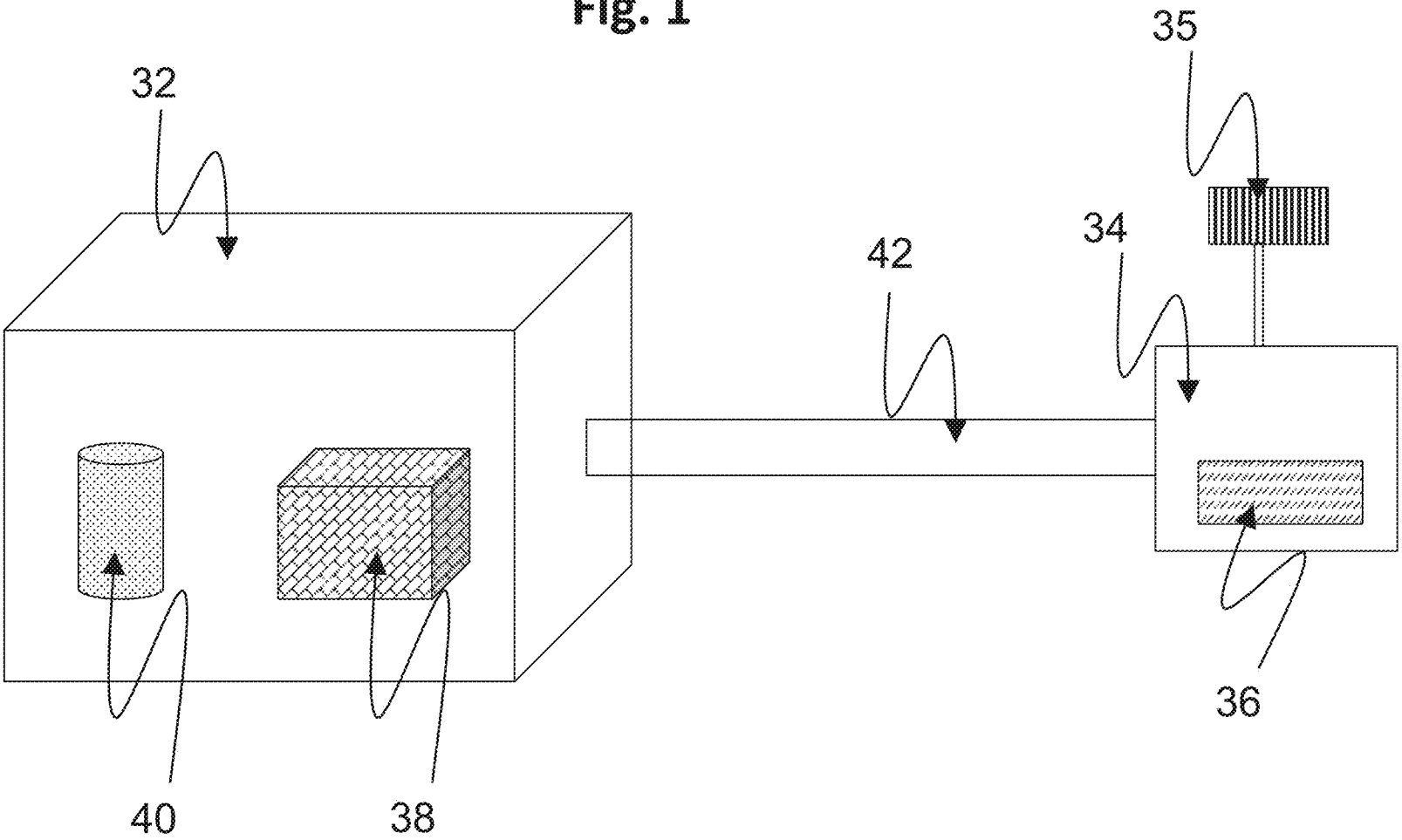
FIG. 1 is a drawing depicting an exemplary EWOD based microfluidic system.
Figure 2:
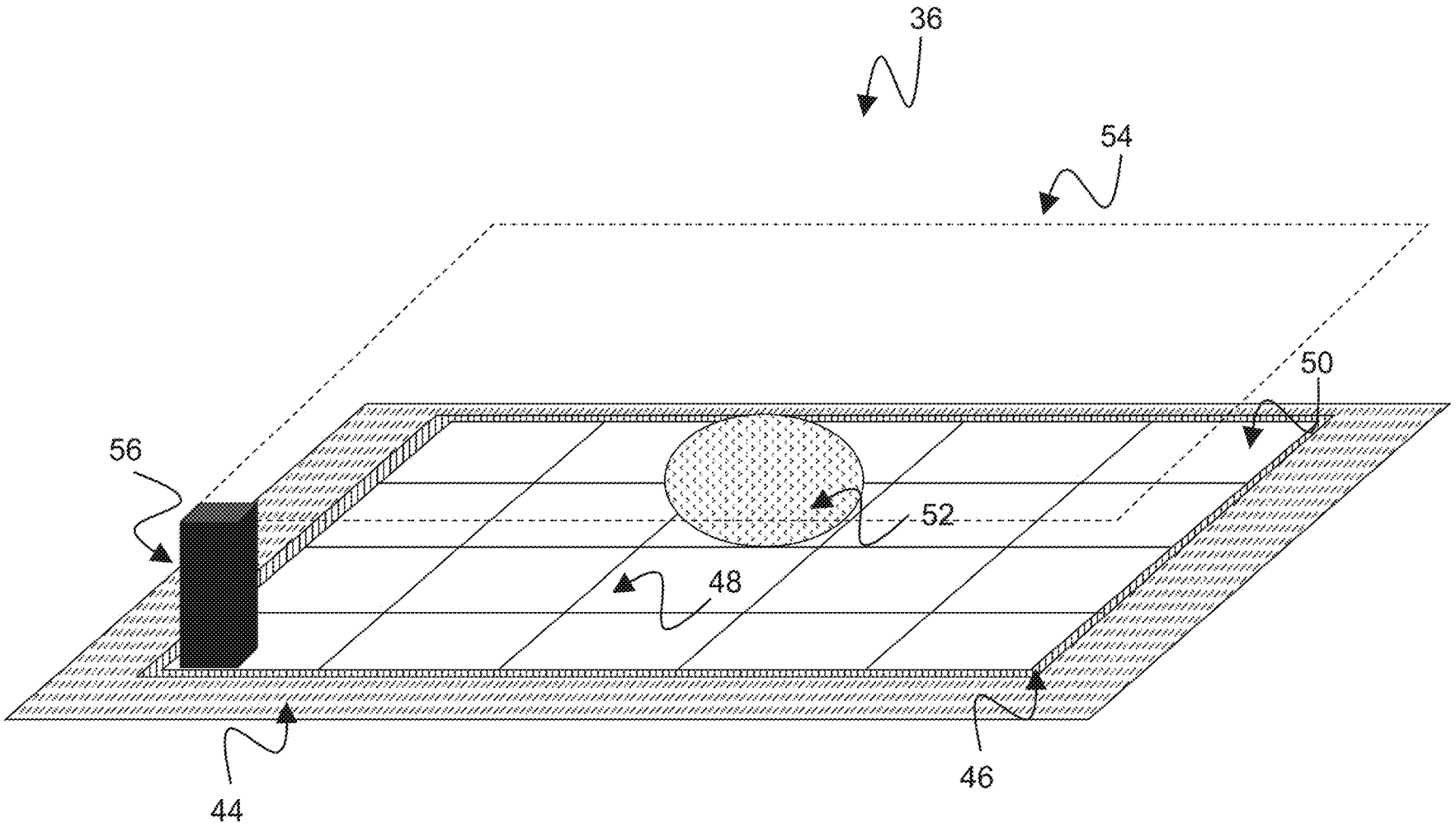
FIG. 2 is a drawing depicting an exemplary AM-EWOD device in a perspective view.
Figure 3:
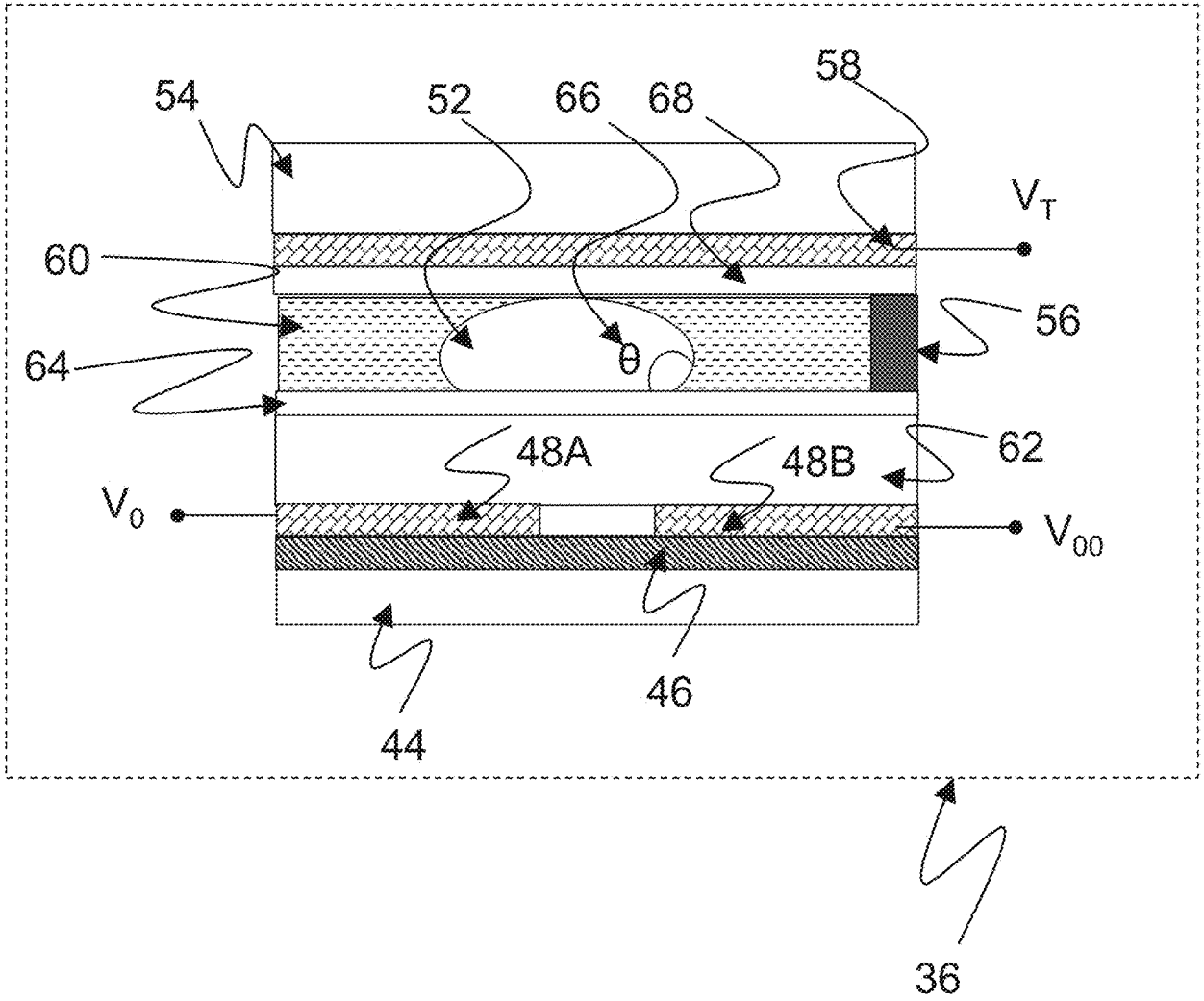
FIG. 3 is a drawing depicting a cross section through some of the array elements of the exemplary AM-EWOD device of FIG. 2.
Figure 4B:
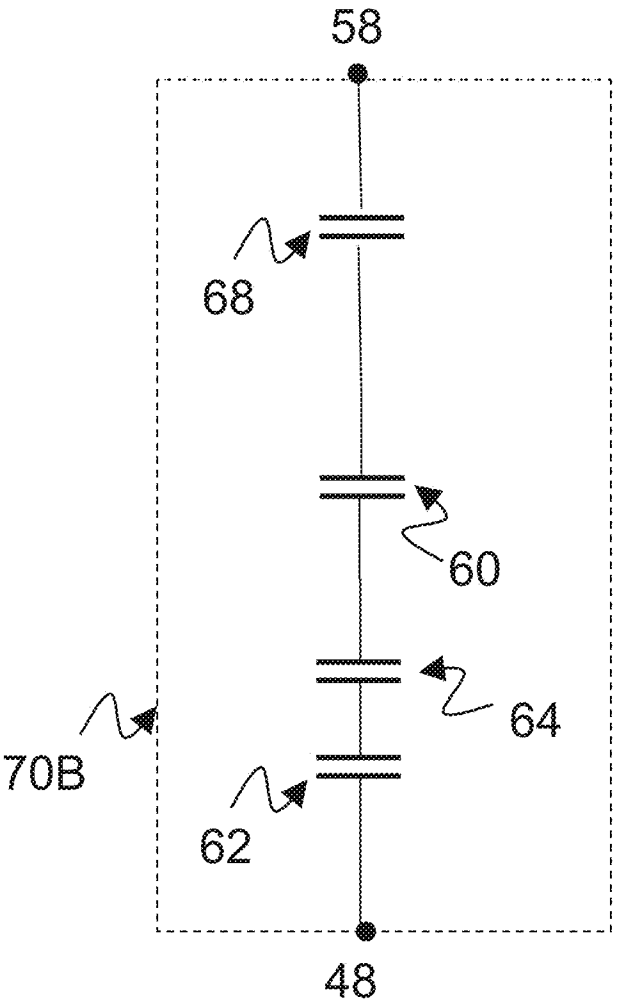
FIG. 4B is a drawing depicting a circuit representation of the electrical load presented at the element electrode when no liquid droplet is present.
Figure 4A:
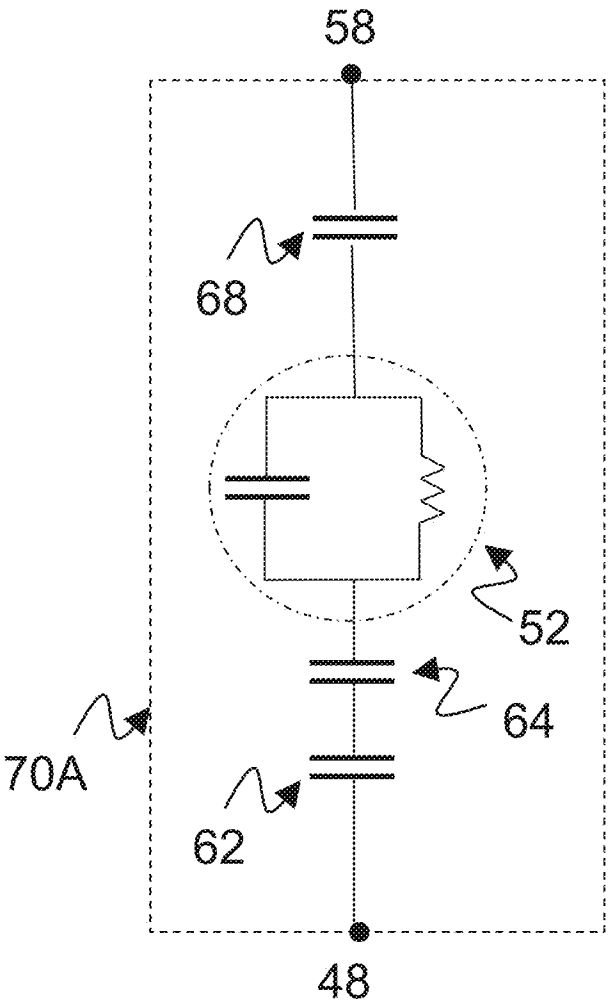
FIG. 4A is a drawing depicting a circuit representation of the electrical load presented at the element electrode when a liquid droplet is present.
Figure 5:
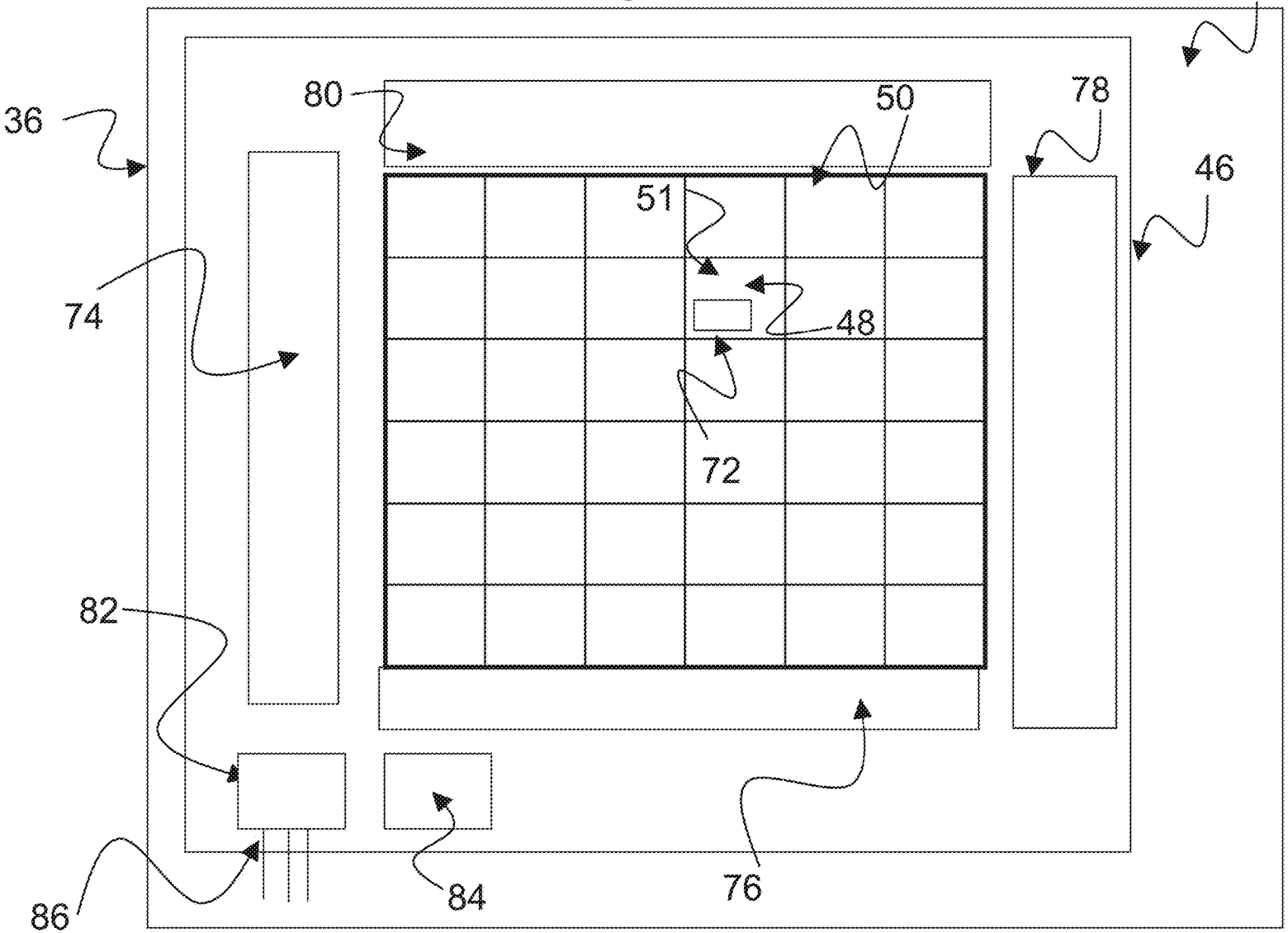
FIG. 5 is a drawing depicting an exemplary arrangement of thin film electronics in the exemplary AM-EWOD device of FIG. 2.
Figure 6:
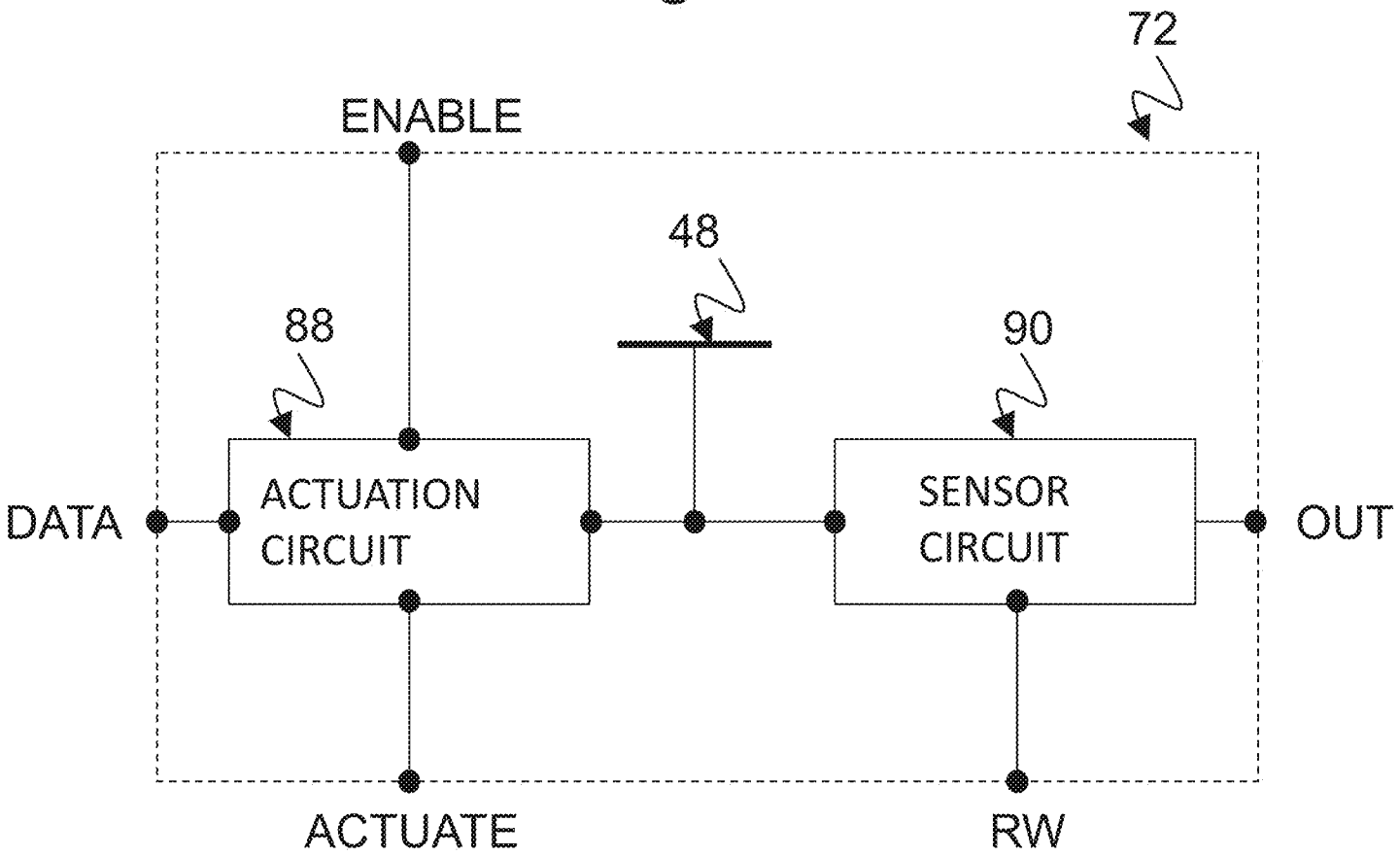
FIG. 6 is a drawing depicting exemplary array element circuitry for an AM-EWOD device.

Embodiments of the present invention will now be described with reference to the drawings, wherein like reference numerals are used to refer to like elements throughout. It will be understood that the figures are not necessarily to scale.

The present invention pertains to systems and methods of operating an EWOD or AM-EWOD device that can accommodate multiple filler fluids having different characteristics that may be employed within a single EWOD device. The requirements of the filler fluid may differ depending upon the particular application for which the EWOD device is to be used. Properties or characteristics of a filler fluid also may need to be different at different stages within a specific assay, sample preparation, or reaction protocol that is to be performed within an EWOD device. The present invention, therefore, provides systems and methods that accommodate the need to use filler fluids of different properties or characteristics by facilitating the use of multiple and different filler fluids within a single EWOD device.

For example, in certain applications it may be necessary to provide within the filler fluid a surfactant so that small droplets can be created from a reservoir by electrowetting manipulation operations. Surfactants are used commonly in the field of microfluidic operations, and examples of suitable surfactants are described in Applicant's commonly owned US 2018/0059056 (Taylor et al., published Mar. 1, 2018). However, once the small droplets have been created, the presence of the surfactant may be undesirable as it limits or prevents later desirable events. For example, droplet speed may be limited by the presence of a surfactant, or downstream processing of an extracted sample may be disturbed by the presence of the surfactant. As another example, some applications may benefit from dissolved gas (for example oxygen) or vapor (for example water vapor) within the filler fluid during a stage of a reaction protocol (e.g. to keep cells alive), but the reaction protocol at other stages may benefit from degassed oil (e.g., during a PCR step). Other applications may benefit from different viscosities of filler fluid, e.g. a low viscosity filler fluid may be preferable for dispensing small droplets from a reservoir, whereas a higher viscosity fluid may be preferable for higher temperature applications to limit the risk of exceeding a flash point or having excessive oil evaporation.

As another example, droplets may be manipulated to form a droplet interface bilayer (DIB) by which two droplets are manipulated to make contact one with another without actual merging to yield a single enlarged droplet. By appropriate choice of surfactants in the system, a lipid bilayer forms the DIB at the interface of the two droplets. DIBs have multiple uses in EWOD applications, including for example forming structures for patch-clamp sensing, for example as described in Martel and Cross, Biomicrofluidics, 6, 012813 (2012), or for sequencing DNA when a nanopore is inserted into the DIB, as described for example in GB1721649.0. Formation of DIBs or emulsions is favored by a low surfactant concentration in a long-chain oil as the surfactant can interfere with other surfactants in the liquid droplet. Such a high viscosity, low surfactant concentration oil is unlikely to yield satisfactory results with other EWOD droplet manipulation operations, such as splitting and dispensing droplets. It may be useful, therefore, to use a short-chain oil with surfactant for certain manipulation operations, and to use a long-chain oil with lower surfactant concentration for forming DIBs.

The present invention, therefore, provides enhanced accommodation of multiple filler fluids having different characteristics that may be employed within a single EWOD device. In exemplary embodiments, a polar fluid source may be dispensed into an EWOD device array by any suitable mechanism. Electrowetting forces are employed to modify the polar fluid to form an aqueous barrier across the EWOD device array that separates the EWOD device array into fluidly separated regions or zones. First and second non-polar filler fluids are then dispensed respectively into the EWOD device on opposites sides of the aqueous barrier, such that the aqueous barrier prevents intermixing between the filler fluids. Additional polar fluid constituting one or more sample and/or reagent polar liquid droplets are dispensed onto the EWOD device. The liquid droplets may be transferred between the different device regions having the different polar fluids by employing electrowetting operations to: reconfigure the aqueous barrier, such as by opening a passage in the aqueous barrier, transfer one or more liquid droplets through the reconfigured aqueous barrier from a first region to a second region of the EWOD device, and reconstituting the aqueous barrier to re-separate the first and second regions. By employing such an aqueous barrier, intermixing of the different filler fluids and any constituents thereof is minimized.

Referring back to FIG. 1 illustrating the overall microfluidic system, among their functions, to implement the features of the present invention, the control electronics 38 may comprise a part of the overall control system that may execute program code embodied as a control application stored within the storage device 40. It will be apparent to a person having ordinary skill in the art of computer programming, and specifically in application programming for electronic control devices, how to program the control system to operate and carry out logical functions associated with the stored control application. Accordingly, details as to specific programming code have been left out for the sake of brevity. The storage device 40 may be configured as a non-transitory computer readable medium, such as random access memory (RAM), a read-only memory (ROM), an erasable programmable read-only memory (EPROM or Flash memory), or any other suitable medium. Also, while the code may be executed by control electronics 38 in accordance with an exemplary embodiment, such control system functionality could also be carried out via dedicated hardware, firmware, software, or combinations thereof, without departing from the scope of the invention.

The control system may be configured to perform some or all of the following functions:

- Define the appropriate timing signals to manipulate liquid droplets on the AM-EWOD device 36.
- Interpret input data representative of sensor information measured by a sensor or sensor circuitry associated with the AM-EWOD device 36, including computing the locations, sizes, centroids, perimeters, and particle constituents of liquid droplets on the AM-EWOD device 36.

Use calculated sensor data to define the appropriate timing signals to manipulate liquid droplets on the AM-EWOD device 36, i.e. acting in a feedback mode.

Provide for implementation of a graphical user interface (GUI) whereby the user may program commands such as droplet operations (e.g. move a droplet), assay operations (e.g. perform an assay), and the GUI may report the results of such operations to the user.

Control any physical implementation components of the system, such as controlling the input and extraction of fluids onto the device array using instruments such as pipettes and like fluid transference devices, controlling movements of external sensing components, and the like.

The control system, such as via the control electronics 38, may supply and control the actuation voltages applied to the electrode array of the microfluidics device 36, such as required voltage and timing signals to perform droplet manipulation operations and sense liquid droplets on the AM-EWOD device 36. The control electronics further may execute the application software to generate and output control voltages for droplet sensing and performing sensing operations.

The various methods described herein pertaining to enhanced accommodation of multiple filler fluids may be performed using structures and devices described with respect to FIGS. 1-6, including for example any control electronics and circuitry, sensing capabilities, and control systems including any processing device that executes computer application code stored on a non-transitory computer readable medium. The following figures illustrate various methods of operating an EWOD or AM-EWOD device, which in particular may be performed by the AM-EWOD device control system executing program code stored on a non-transitory computer readable medium.

An aspect of the invention, therefore, is a method of operating an electrowetting on dielectric (EWOD) device that performs electrowetting operations on fluids dispensed into the EWOD device, which provides enhanced operation for using multiple non-polar filler fluids. In exemplary embodiments, the method of operating includes the steps of: dispensing a polar fluid source into the EWOD device; performing an electrowetting operation to generate an aqueous barrier from the polar fluid source, wherein the aqueous barrier separates the EWOD device into a first region and a second region that are fluidly separated from each other by the aqueous barrier; inputting a non-polar first filler fluid into the first region; inputting a non-polar second filler fluid into the second region; dispensing a polar liquid droplet into the first region; transferring the polar liquid droplet from the first region to the second region by performing an electrowetting operation to reconfigure the aqueous barrier, and performing an electrowetting operation to move the polar liquid droplet from the first region to the second region through the reconfigured aqueous barrier; and performing an electrowetting operation to reconstitute the aqueous barrier to fluidly separate the first region from the second region. The methods of the present invention may be performed by an EWOD control system executing program code stored on a non-transitory computer readable medium.

Figure 7:
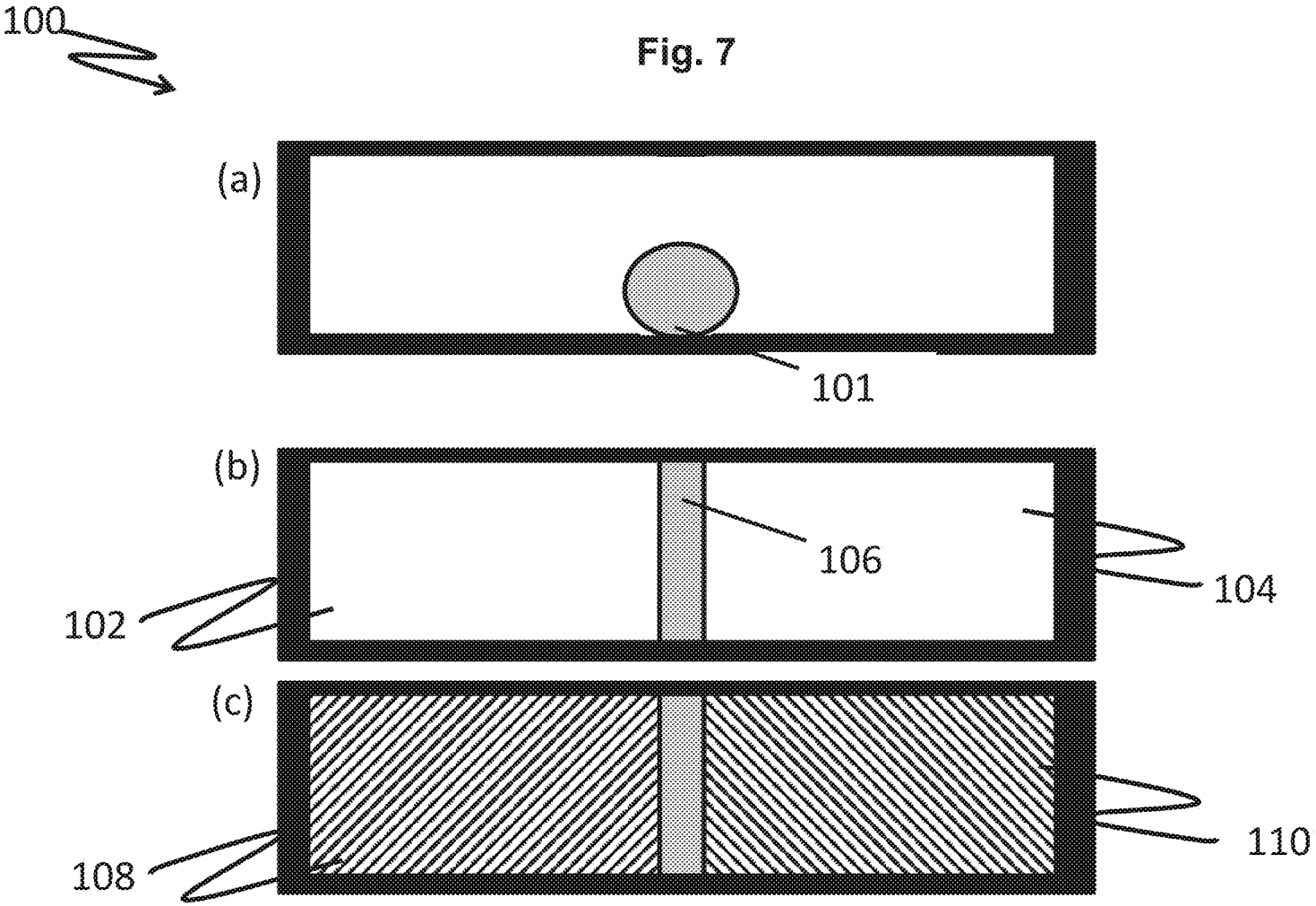
FIG. 7 is a drawing depicting an exemplary method of operating an EWOD device in accordance with embodiments of the present invention, illustrating steps (a) through (f) and using an aqueous barrier to accommodate using multiple filler fluids having different characteristics.
Figure 7:
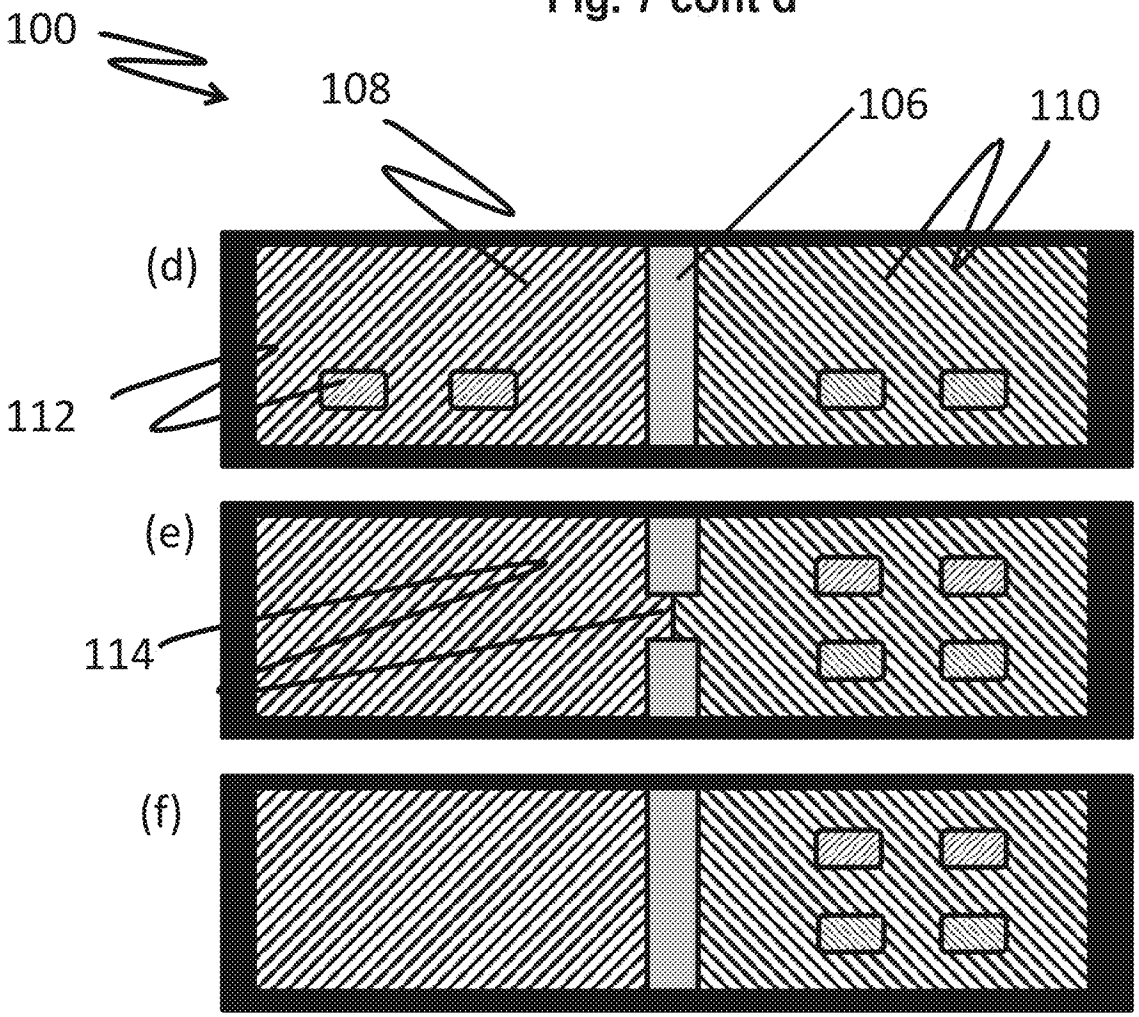

FIG. 7 is a drawing depicting an exemplary method of operating an EWOD device 100 in accordance with embodiments of the present invention, illustrating steps (a) through (f) to accommodate using multiple filler fluids having different characteristics. The EWOD device 100 is identified broadly, and it will be appreciated that an EWOD device having any suitable configuration, including as an example the configuration of FIGS. 1-6, may be employed.

In step (a) of FIG. 7, a polar fluid source 101 may be dispensed onto the EWOD device array 100 by any suitable mechanism. The polar fluid source 101 may be side loaded or otherwise dispensed as a single volume, or may be generated by using electrowetting forces to aggregate multiple fluid sources dispensed onto the EWOD device array. Electrowetting forces further may be used to position the polar fluid source 101 at a desired position on the EWOD device array 100. In step (b) of FIG. 7, electrowetting forces are employed to generate an aqueous barrier 106 from the polar fluid source 101 that divides the EWOD device array 100 into fluidly separated first and second regions or zones 102 and 104. The aqueous barrier 106 may be formed by manipulating the polar fluid source by electrowetting forces to form an elongated barrier droplet 106 that spans the EWOD device array to generate the regions or zones 102 and 104. Although two zones are illustrated as an example in FIG. 7, it will be appreciated that any number of aqueous barriers 106 may be formed to divide the EWOD device array 100 into any number of regions or zones as may be suitable for any particular application, and at any position along the EWOD device array.

In step (c) of FIG. 7, a filler fluid, such as an oil, may be inputted into each of the first and second regions 102 and 104 by any suitable input method. For illustration purposes, a first filler fluid 108 is shown in the first region 102 using a first lined hashing, and a second filler fluid 110 is shown in the second region 104 using an opposing lined hashing to show the different filler fluids in the different regions. In practice, the first and second filler fluids may be the same filler fluid, or the first and second filler fluids may be different filler fluids having different characteristics, constituents, or properties as may be suitable for any particular application.

The sequence of steps (b) and (c) in FIG. 7 illustrate a variation in which the aqueous barrier 106 is formed within EWOD device 100 before filler fluids 108 and 110 are loaded into the EWOD device. As referenced above, the aqueous barrier 106 can be formed by loading an aqueous, polar fluid source into the device, and using an electrowetting force to stretch the polar fluid into an elongated barrier droplet that spans essentially the width of the EWOD device array 100. In this manner, when filler fluids 108 and 110 are subsequently loaded into the EWOD device 100 from opposing sides of the aqueous barrier 106, the filler fluids do not come in contact with each other and thus do not mix together in any way. Accordingly, the filler fluids are maintained separated from each other by the aqueous barrier 106. In some applications, a surfactant may be included in the polar fluid used to generate the aqueous barrier 106 to ensure successful loading of the polar fluid into the EWOD device, and/or formation of an elongated barrier droplet. An alternative may be to employ a relative high magnitude actuation voltage to manipulate the polar fluid to form the aqueous barrier 106. In other applications, depending upon the liquid constituents there may be no requirement for a surfactant in the polar fluid for successful elongated barrier droplet formation, even at lower actuation voltages. Accordingly, it will be appreciated that the precise manner of forming the aqueous barrier 106 to divide the EWOD device 100 into regions or zones 102 and 104 may be adapted as may be suitable for any particular application.

As described above, the EWOD device 100 may include sensor elements, such as for example external sensors or sensing circuitry integrated into the array element circuitry of each array element. Sensor elements may be used to detect when the aqueous barrier 106 is fully formed, and hence when it is appropriate to load the filler fluids into the different regions to prevent mixing of the filler fluids. The microfluidic system may employ a suitable output through a user interface, such as a visual or audio indicator, that the EWOD device is in a ready state to receive the filler fluids. Such indicators may prompt an operator for manual loading of the filler fluids, or the system may be fully automated whereby the sensor elements send a signal to the control system, which may control a fluid loading instrument to trigger automatic loading of the filler fluids.

In step (d) of FIG. 7, additional polar, aqueous liquid droplets 112 may be inputted into the EWOD device 100 by any suitable input method. The liquid droplets 112 may be any number of sample and/or reagent droplets that are to be employed in a reaction protocol or other application to be performed by the EWOD device. As shown in step (d) of FIG. 7, the liquid droplets may be loaded into the EWOD device on opposite sides of the aqueous barrier 106 to maintain any desired separation of the inputted liquid droplets 112. For example, the liquid droplets may be sample droplets on one side of the aqueous barrier and reagent droplets on the other side of the aqueous barrier that are not to mix until an appropriate reaction phase. As another example, different electrowetting droplet operations can be carried out independently on the two sides of the aqueous barrier 106, i.e., a first reaction step or series of reactions steps may be carried out in region 102, while a second reaction step or series of reactions steps independently may be carried out in region 104.

There may come a time when it is desirable that one or more liquid droplets 112 be moved between the regions 102 and 104. For example, step (e) of FIG. 7 illustrates an exemplary operation in which liquid droplets 112 are moved from the first region 102 into the second region 104. It may be desirable to perform additional reaction steps using product droplets from the reaction steps performed in the first region 102, or for any suitable downstream processing. It may be that the first filler fluid 108 is suitable for preparation operations, but not suitable for any subsequent or downstream processing, while the second filler fluid 110 in contrast is suitable for the subsequent or downstream processing.

As shown in step (e) of FIG. 7, to facilitate transfer of one or more liquid droplets 112 from the first region 102 to the second region 104, an electrowetting operation may be performed to reconfigure the polar aqueous barrier 106 to form a passage 114, through which one or more liquid droplets 112 can pass between regions (in this example from the first region 102 into the second region 104). Accordingly, once the passage 114 is formed, additional electrowetting operations may be performed to move any of the liquid droplets 112 between the two regions (again in this example from region 102 into region 104). As shown in step (f) of FIG. 7, once the desired movement operations are complete, electrowetting operations may be performed to close the passage 114, thereby reconstituting the complete aqueous barrier 106 and fluidly separating the first region from the second region. The opening of the aqueous barrier passage 114 in step (e) and the closing of the aqueous barrier passage 114 in step (f) can be controlled by the device control system to be timed optimally with the movement of the liquid droplets 112 between regions (such as from the first region 102 to the second region 104 in this example). By optimally timing control of opening and closing the passage 114, the interval during which there is direct contact between the first filler fluid 108 and the second filler fluid 110 is minimized. In this manner, the opportunity for filler fluids 108 and 110 to intermingle and mix is kept minimal. The propensity for mixing of the different filler fluids may also be minimized when the respective filler fluids are natively immiscible, which may render precise timing of the passage control to be less significant.

Figure 8:
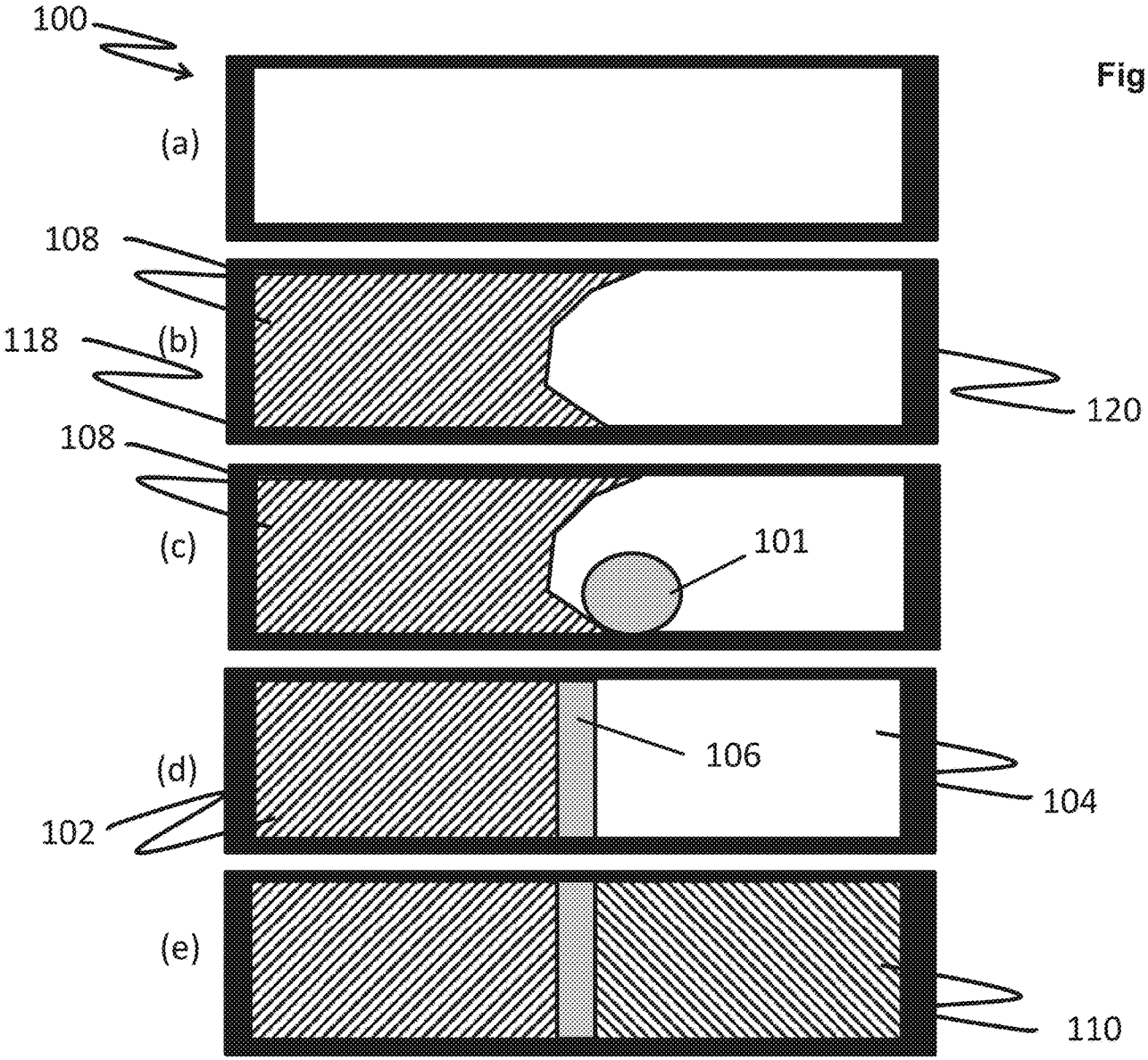
FIG. 8 is a drawing depicting another exemplary method of operating an EWOD device in accordance with embodiments of the present invention, illustrating steps (a) through (e) and illustrating an alternative method of forming the aqueous barrier and inputting the filler fluids.

FIG. 8 is a drawing depicting another exemplary method of operating an EWOD device 100 in accordance with embodiments of the present invention, illustrating steps (a) through (e) to accommodate using multiple filler fluids having different characteristics. FIG. 8 essentially represents a variation on the operation of FIG. 7, illustrating an alternative method of forming the aqueous barrier 106 and inputting the first and second filler fluids 108 and 110.

Step (a) of FIG. 8 depicts the EWOD device 100 in an initial state prior to the input of fluids. In step (b) of FIG. 8, the first filler fluid 108 is inputted into the EWOD device 100, which in this example is performed prior to inputting the aqueous polar fluid source 101 that may be used to form the aqueous barrier. The first filler fluid 108 may be inputted at or adjacent to a first end 118 of the EWOD device 100, after which the first filler 108 migrates toward a second end 120 of the EWOD device 100 opposite from the first end 118. The distance of migration along the EWOD device typically depends upon the amount of the filler fluid that is inputted into the EWOD device.

At step (c) of FIG. 8, the aqueous or polar fluid source 101 may be introduced into the EWOD device 100 at a location at which the first filler fluid 108 has made initial contact, but has not completely filled the EWOD device. The first filler fluid 108 may comprise a surfactant, which may partition across the interface of the polar fluid source 101, thereby reducing the voltage necessary to manipulate the polar fluid by electrowetting. For example, the polar fluid source 101 may be dispensed along a side edge of the EWOD device 100. As shown in step (d) of FIG. 8, electrowetting operations may be performed to elongate the polar fluid source 101 into the aqueous barrier 106 comparably as shown in FIG. 7, and further to position the aqueous barrier to form the regions 102 and 104 of the desired size and at the desired location. At step (e) of FIG. 8, the second filler fluid 110 may be inputted into the second region 104 on an opposite side of the aqueous barrier 106 relative to the first filler fluid 108 in region 102. The embodiment of FIG. 8 has an advantage in that it may not be necessary to use a surfactant in the polar fluid, as the surfactant could potentially be provided in the first filler fluid 108, and it further may not be necessary to use a high EWOD voltage, which may be used in the previous embodiment. In this context, a boundary between a low voltage versus a high voltage may be approximately 20 V. As a relative manner, a high voltage may be a voltage that the TFTs would not be capable of applying (which typically would be >20V) in an active matrix device. If voltages greater than these were needed, they would have to be supplied by passively driven electrodes (not active matrix) such as, for example, as in one of the devices described in U.S. Pat. No. 8,658,111.

To form the aqueous barrier 106, the polar fluid is drawn across the width of the EWOD device 100 by electrowetting forces. Electrowetting forces further may be used to move the aqueous barrier 106 to any desired location along the EWOD device 100. In this manner, the formation and manipulation of the aqueous barrier 106 may be used to rearrange the boundary of the first filler fluid 108 into a well-controlled shape or region as illustrated in step (d). Similarly as in the previous embodiments, sensor elements may be used to detect the boundary of the first filler fluid when initially loaded, and guide the aqueous barrier 106 into position, ensuring that the first filler fluid 108 resides on only one side of the resultant barrier in the region 102. As referenced above, once the aqueous barrier 106 has been formed and appropriately positioned to contain the first filler fluid 108 in the region 102, the second filler fluid 110 may be introduced into the EWOD device 100 in the region 104 as illustrated in step (e). Thereafter, polar sample and/or reagent droplets may be introduced into filler fluids 108 and 110, and electrowetting droplet operations may be performed for moving liquid droplets between the regions 102 and 104 by reconfiguring the aqueous barrier 106, as described above with respect to steps (d), (e), and (f) of FIG. 7.

In a variant of this embodiment, a quantity of surfactant containing filler fluid could be loaded simultaneously with the polar fluid source to form the aqueous barrier, for example by loading two different fluids within an input instrument such as a pipette, which would provide the advantages of the this embodiment using a single fluid inputting step. The two filler fluids could then be loaded on either side of the aqueous barrier comparably as in the first embodiment.

Figure 9:
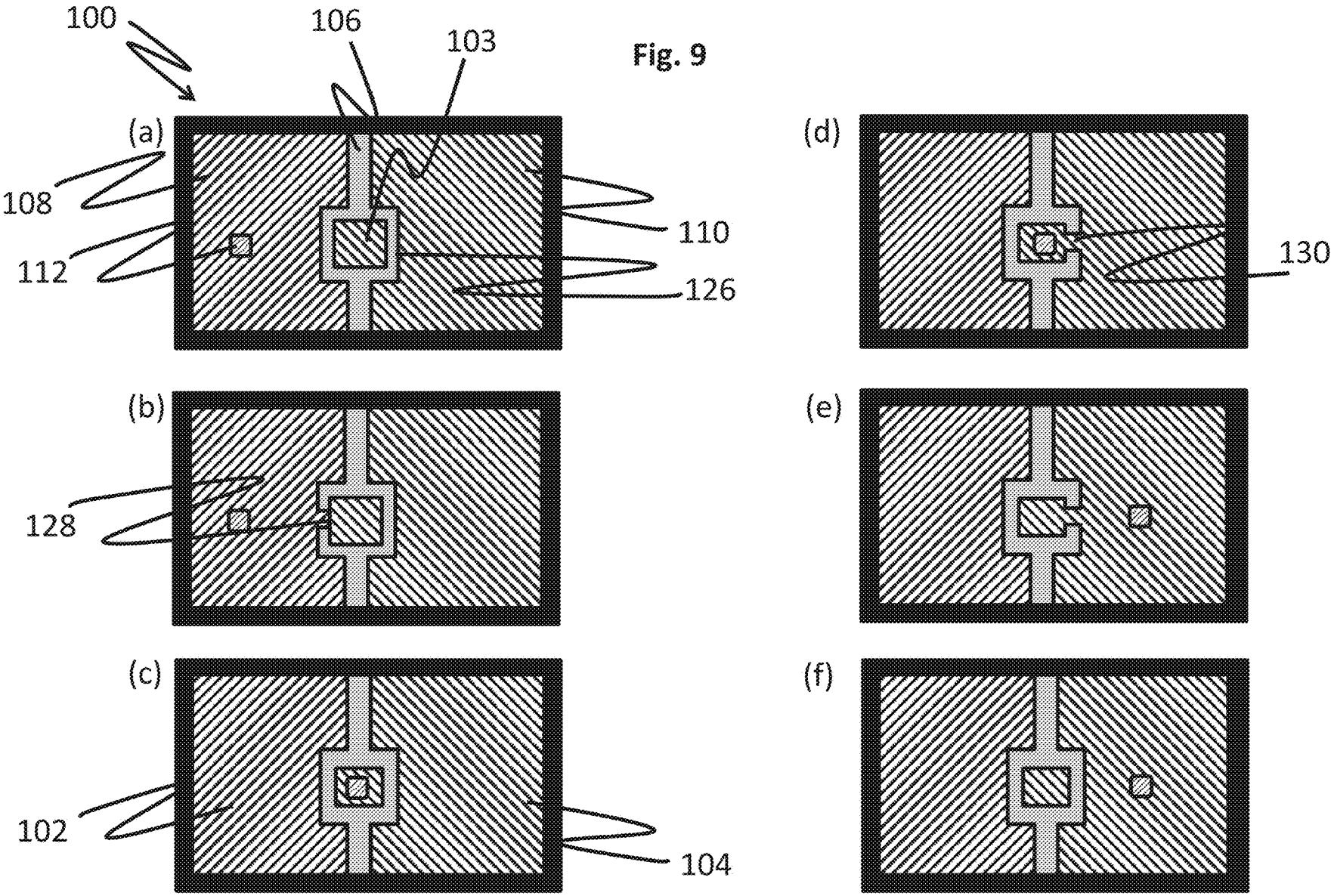
FIG. 9 is a drawing depicting another exemplary method of operating an EWOD device in accordance with embodiments of the present invention, illustrating steps (a) through (f) and using an aqueous barrier configuration in which the aqueous barrier includes a double walled portion to perform a double gated transference operation.

FIG. 9 is a drawing depicting another exemplary method of operating an EWOD device 100 in accordance with embodiments of the present invention, illustrating steps (a) through (f) to accommodate using multiple filler fluids having different characteristics. FIG. 9 essentially is a variation on the operation of the previous embodiments, and illustrating an aqueous barrier configuration in which the aqueous barrier includes a double walled section to perform a double gated transference operation by which the aqueous barrier is reconfigured to form passages sequentially through different limbs of the double walled section.

In this embodiment, electrowetting forces may be employed to manipulate a polar fluid source 101 into an aqueous barrier 106 comparably as illustrated in FIGS. 7 and 8. The first and second filler fluids 108 and 110 then may be inputted into the EWOD device 100, followed by additional polar fluid constituting sample and/or reagent droplets 112 (one droplet is shown in FIG. 9, although again any suitable number of liquid droplets 112 may be dispensed as warranted for a particular application). Accordingly, the embodiment of FIG. 9 initially may follow steps (a) through (d) of FIG. 7 or (b) through (e) of FIG. 8.

Further in this embodiment, as shown in step (a) of FIG. 9, the electrowetting forces additionally may be employed to reconfigure the aqueous barrier 106 to form a double walled section 126. The double walled section 126 encloses a third region 103 on the EWOD device that is fluidly separated from the first region 102 containing the first filler fluid 108 and the second region 104 containing the second filler fluid 110 by said double walled section. The double walled section 126 may be formed after any initial or preparation electrowetting operations have been completed on the liquid droplets 112 in either of the filler fluids 108 or 110 as located within their respective regions. In this example, the third region 103 is illustrated as being formed to contain the second polar fluid 110, although alternatively the third region 103 may be formed to contain the first polar fluid 108.

With the double walled section, the embodiment of FIG. 9 provides for an alternative method of transferring sample droplets 112 from filler fluid 108 to filler fluid 110 or vice versa. As referenced above, the double walled section 126 of the aqueous barrier 106 is formed whereby a fraction of filler fluid 110 (or alternatively filler fluid 108) is confined with said double walled section 126. The configuration of the double walled section 126 of aqueous barrier 106 provides for a double gated transference of liquid droplets 112 between the first region or zone 102 and another region or zone 104.

As depicted in step (b) of FIG. 9, electrowetting forces are employed to reconfigure the aqueous barrier 106 to open a first passage 128 in a first limb of the double walled section 126, which places the third region 103 encompassed by the doubled walled section 126 in fluid communication with one of the other regions. In this example, the third region 103 is fluidly connected to first region 102, although the first passage could also be formed to fluidly the third region 103 with the second region 104. As shown in step (c) of FIG. 9, the sample/reagent droplet 112 then in moved by electrowetting forces through the first passage 128 into the third region 103 encompassed by the double walled section 126 of the aqueous barrier 106. Electrowetting forces are then employed to reconstitute the aqueous barrier 106 to close the first passage 128, thereby enclosing the liquid droplet 112 within the third region 103 encompassed by the double walled section 126. As depicted in step (d) of FIG. 9, electrowetting forces then are employed to reconfigure the aqueous barrier 106 to open a second passage 130 in a second limb of the double walled section 126, which places the third region 103 encompassed by the doubled walled section 126 in fluid communication with a different one of the other regions, in this example the second region 104. As shown in step (e) of FIG. 9, the sample/reagent droplet 112 then is moved by electrowetting forces through the second passage 130 into the second region 104. As shown in step (f) of FIG. 9, electrowetting forces are then employed to reconstitute the aqueous barrier 106 to close the second passage 130, after which subsequent processing of the liquid droplet 112 may be performed within the second region 104 of the EWOD device 100 that contains the second filler fluid 110.

The double gated transference operation has advantages in transferring fluids between different regions of the EWOD device array. By using a double walled aqueous barrier section surrounding an internal volume of filler fluid separating different regions or zones of the device array, the transference operation further limits any potential bulk mixing of the first filler fluid 108 into the second filler fluid 110, and vice versa. Such segregation of device regions or zones may be of particular benefit when electrowetting droplet operations, or downstream processes, to which sample droplets might be transferred may be compromised by the presence of one filler fluid in the other, or an additive such as a surfactant that may be present in one filler fluid and not the other.

For example, suppose the first filler fluid 108 in the first region 102 contains a surfactant that is undesirable in the second filler fluid 110 in the second region 104, and that the droplets 112 are to move from region 102 to region 104. In such case, the aqueous barrier 106 is arranged so that the internal volume of the third region 103 is filled with the second filler fluid 110 of region 104 as shown in FIG. 9. When liquid droplets 112 move from the first region 102 into the third region 103 encompassed by the double walled section 126, a certain amount of surfactant may follow the liquid droplets 112 into the third region 103, but the surfactant concentration is expected to be negligible as compared to the concentration in first region 102. Therefore, when the double walled section 126 of the aqueous barrier 106 is subsequently opened to allow droplets 112 to move into the second region 104, the second filler fluid 110 of second region 104 is at least making contact with a filler fluid that is intermediate in surfactant concentration between region 102 and region 104 (and typically substantially less than the concentration in region 102), and hence the amount of surfactant that carries over from first region 102 to second region 104 is minimized as compared to the embodiment of FIG. 7 in which the double walled section is not employed.

Additionally, when the liquid droplets are fully enclosed within the third region, additional electrowetting manipulation operations may be performed within the EWOD device region enclosed by the double walled barrier section. For example, droplets and/or the boundary of the third region may be shuffled to perform a kind of washing effect on the droplets within the third region, before the double walled barrier section is opened for transference to another device region. The result of such a washing effect is to reduce contamination or partial contamination by additional mixing within the third region, which serves to homogenize the composition of the third region.

The double gated transference operation can be extended to include any number of barrier-enclosed regions of filler fluid, so that the droplets may pass through a plurality of gates in the transference between different regions on the device array. Performing multiple double gated transference operations further diminishes the potential for undesirable transfer of or mixing of different filler fluids, including any surfactant and other additive constituents of the filler fluids. In addition, the embodiments described above with respect to FIG. 7-9 are representative of instances in which there are two distinct regions or zones formed within the EWOD device, and hence two different filler fluids are used. The principles of the embodiments can be extended to any number of zones or regions within the EWOD device, with any number of different filler fluid compositions. In variations, some filler fluids may be the same base fluid with different surfactant or other additives, and some filler fluids may be miscible and some may be immiscible.

In alternative embodiments, EWOD processing employing multiple and different filler fluids may be performed without forming an aqueous barrier defining fluidly separated regions or zones within the EWOD device. In such alternative embodiments, the use of multiple filler fluids is carried out sequentially, i.e., at different times rather than simultaneously at different positions within the EWOD device. Another method of operating an EWOD device, therefore, may include the steps of: inputting a non-polar first filler fluid into the EWOD device; dispensing a polar liquid droplet into the EWOD device, wherein the polar liquid droplet is surrounded by the first filler fluid; performing an electrowetting operation to perform a droplet manipulation operation on the polar liquid droplet; extracting the first filler fluid from the EWOD device while actuating a portion of array elements of the EWOD device to maintain a position of the polar liquid droplet within the EWOD device; and inputting a non-polar second filler fluid into the EWOD device while actuating a portion of array elements of the EWOD device to maintain a position of the polar liquid droplet within the EWOD device. The positions of the polar liquid droplet during extraction of the first filler fluid and input of the second filler fluid may be the same or different.

Figure 10:
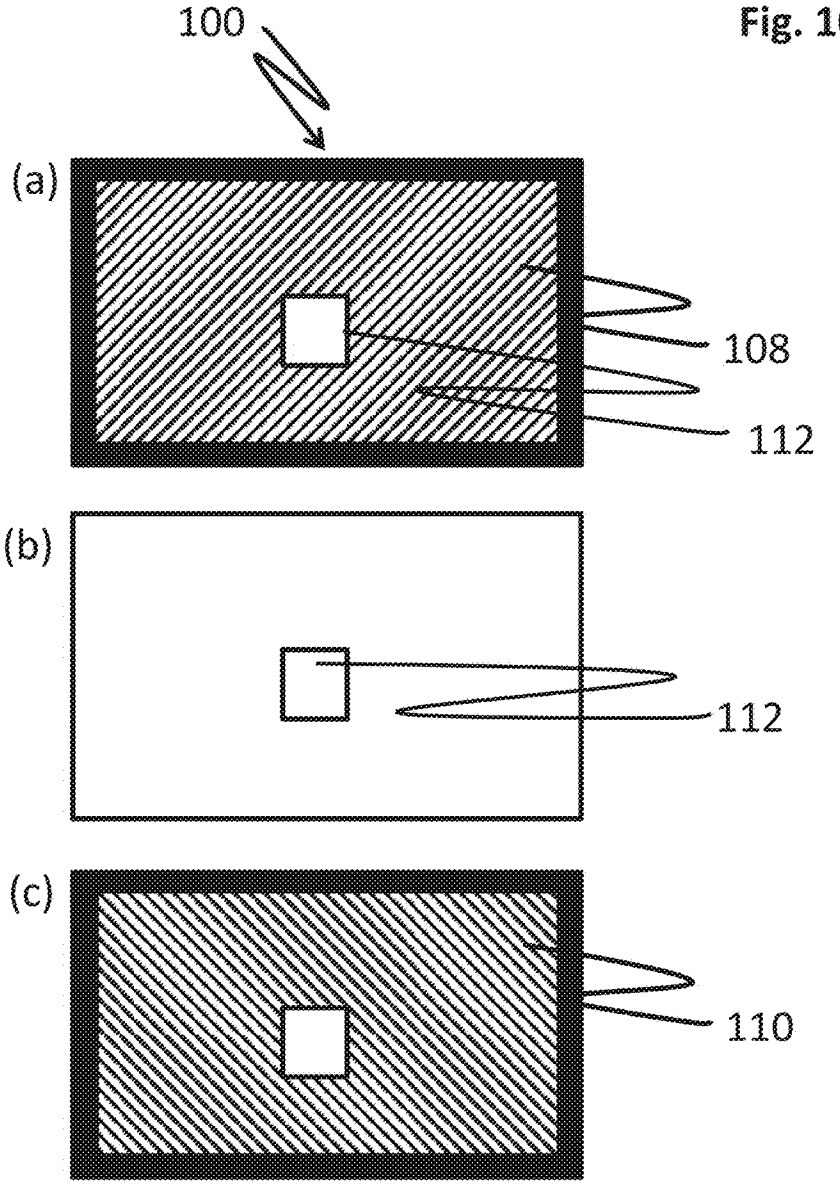
FIG. 10 is a drawing depicting another exemplary method of operating an EWOD device in accordance with embodiments of the present invention, illustrating steps (a) through (c) and illustrating sequential usage of multiple filler fluids at different times.

Accordingly, FIG. 10 is a drawing depicting another exemplary method of operating an EWOD device 100 in accordance with embodiments of the present invention, illustrating steps (a) through (c) to accommodate using multiple filler fluids having different characteristics. FIG. 10 illustrates an embodiment of sequential usages of the multiple filler fluids at different times.

In step (a) of FIG. 10, initially the EWOD device 100 is filled with a first filler fluid 108, and then aqueous reagent and/or sample droplets 112 (only one droplet is shown for illustration) are loaded into the EWOD device by any suitable dispensing operations. After any initial or preparation electrowetting operations have been carried out within the first filler fluid 108, the first filler fluid 108 may be aspirated or extracted from the EWOD device 100 by any suitable fluid extraction mechanism. For first filler fluid extraction, the aqueous liquid droplet 112 is maintained in place on the EWOD device array by actuating one or more electrowetting electrodes beneath the liquid sample droplet to hold the position of the liquid droplet 112 using an electrowetting force. As shown in step (b) of FIG. 10, the first filler fluid 108 may then be drawn out of the EWOD device 100 either manually or automatically. Exemplary mechanisms for withdrawing the first filler fluid could include but are not limited to a pipette, syringe, pump, absorbance (e.g. via a wick), or gravity (tipping the fluid out). Careful positioning of the filler fluid extraction point relative to the liquid droplets 112 may be performed for efficient and complete extraction of the first filler fluid, and to mitigate significant carry over contamination of the first filler fluid 108 into a second filler fluid 110. At the same time, it may be advantageous to extract any unwanted aqueous droplets that are not required for the next step of the protocol. These droplets would be left unactuated, which would allow them to be drawn out by the same aspiration mechanism that is used to draw out the first filler fluid. Particular care is to be taken to avoid uncontrolled mixing of those unwanted aqueous droplets with those droplets which are required to stay in (and are therefore distinguished from the unwanted droplets by the fact that they are actuated to resist the aspiration force). To prevent such a mishap from occurring, it may be beneficial to coalesce the unwanted droplets by electrowetting and gather the resultant 'waste' droplet close to the aspiration point in order to ensure that it is aspirated cleanly and in a controlled way, with little risk of mixing with droplets that are required to preserved in the device. Step (b) of FIG. 10 illustrates the state of the EWOD device 100, following extraction of the first filler fluid 108 with the liquid droplet 112 being maintained in position by electrowetting forces.

As shown in step (c) of FIG. 10, after the first filler fluid 108 has been sufficiently aspirated or extracted, the second filler fluid 110 may be dispensed into the EWOD device 100, while the electrodes beneath liquid droplet 112 remain actuated to mitigate the incoming filler fluid 110 from displacing the liquid droplet 112. Any subsequent droplet operations and/or measurements may then be carried out within the second filler fluid 110. Such sequential operations of extracting and inputting different filler fluids can be extended to any number of subsequent filler fluids, which may be sequentially added to and aspirated from the EWOD device 100. As described above, any liquid droplet 112 may be held in place by electrowetting forces during filler fluid extraction and input exchanges.

The principles of the sequential EWOD device operation of FIG. 10 further may be extended to a flow-through system whereby the first filler fluid 108 is not necessarily extracted from EWOD device 100 in a single step, but is displaced from the EWOD device 100 by a second filler fluid 110 that is delivered into EWOD device 100, gradually replacing the first filler fluid 108. The second filler fluid 110 may be dispensed into the EWOD device 100 using, for example, a syringe, a pipette, a mechanical pump or by any other suitable mechanism.

Furthermore, the principles described above in connection with the various embodiments of FIG. 7-10 may be combined into hybrid operations, in which simultaneous and sequential use of one or more filler fluids may be combined. The multiple polar fluids may be the same or different, or may have different additives (such as surfactants) added to a common base filler fluid. For example, an aqueous barrier could be used to separate three zones on the EWOD device, the middle of which is connected to pumps that can be used to continuously wash a set of liquid droplets with an intermediate filler fluid, before transferring the droplets from the first filler fluid, through the second filler fluid, and into another filler fluid. Other properties of the filler fluids may differ. For example, the first filler fluid may be oxygenated and the second filler fluid is deoxygenated, wherein the base filler fluids are the same. As another example, the first filler fluid may have a different melting and/or boiling temperature as compared to the second filler fluid. The first filler fluid may include a first surfactant and the second filler fluid may include a second and different surfactant, wherein the base filler fluids are the same. It will be appreciated that the principles of the embodiments may be applied to filler fluids differing as to any associated properties as may be warranted for a particular application.

In another embodiment, when the distinguishing characteristic between the filler fluids is the concentration or presence of a surfactant, an alternative method of preventing surfactant transference is to remove or reduce the surfactant from a first (and only) filler fluid by providing a surfactant-removing droplet or droplets that move throughout the appropriate region of the device, drawing the surfactant from the filler fluid phase into the aqueous droplets. As such, by moving such droplet(s) around the EWOD device array, the concentration of surfactant initially present in the filler fluid phase would fall as the surfactant-removing droplets are moved throughout the device, achieving a similar effect to having a second filler fluid with either no surfactant or a lower concentration of surfactant.

In each of the foregoing EWOD operation methods depicted in FIGS. 7-10, the beneficial characteristics of an AM-EWOD device such as depicted in FIGS. 1-6 are utilized to achieve the selective droplet manipulations, including for aqueous barrier generation, reconfiguring and reconstituting the aqueous barrier such as by opening and closing of barrier passages, and the related inputting and dispensing of multiple filler fluids. In use, a two-dimensional element array (x, y) defines the active area within which droplet manipulation operations may be performed. The systems and processes of the present invention may be implemented within an AM-EWOD element array of any (x, y) dimensional size. The two-dimensional size determines the respective volume of fluid that may be controlled within the device. Typically, an EWOD device processor or control system is configured to follow a reaction protocol that is embodied as program code stored on a non-transitory computer readable medium, such as described with respect to FIG. 1. In accordance with the reaction protocol, the processor generates control signals for applying selective actuation voltages to the array elements of the AM-EWOD device to generate electrowetting forces to perform the desired droplet manipulation operations. The reaction protocol may contain a series of one or more droplet manipulation operations that may be performed in sequence, or simultaneously, to achieve a desired outcome in accordance with the reaction protocol. Information contained in system memory devices may be used throughout the implementation of a reaction protocol by the processor to implement the desired droplet operations and filler fluid exchanges to obtain a resultant droplet configuration that is suitable for subsequent processing in accordance with a reaction workflow.

An aspect of the invention, therefore, is a method of operating an electrowetting on dielectric (EWOD) device that performs electrowetting operations on fluids dispensed into the EWOD device, which provides enhanced operation for using multiple non-polar filler fluids. In exemplary embodiments, the method of operating includes the steps of: dispensing a polar fluid source into the EWOD device; performing an electrowetting operation to generate an aqueous barrier from the polar fluid source, wherein the aqueous barrier separates the EWOD device into a first region and a second region that are fluidly separated from each other by the aqueous barrier; inputting a non-polar first filler fluid into the first region; inputting a non-polar second filler fluid into the second region; dispensing a polar liquid droplet into the first region; transferring the polar liquid droplet from the first region to the second region by performing an electrowetting operation to reconfigure the aqueous barrier, and performing an electrowetting operation to move the polar liquid droplet from the first region to the second region through the reconfigured aqueous barrier; and performing an electrowetting operation to reconstitute the aqueous barrier to fluidly separate the first region from the second region. The method of operating may include one or more of the following features, either individually or in combination.

In an exemplary embodiment of the method of operating, reconfiguring the aqueous barrier comprises performing an electrowetting operation to open a passage through the aqueous barrier, and reconstituting the aqueous barrier comprises performing an electrowetting operation to close the passage.

In an exemplary embodiment of the method of operating, transferring the polar liquid droplet from the first region to the second region comprises: performing an electrowetting operation to reconfigure the aqueous barrier to form a double walled section of the aqueous barrier enclosing a third region of the EWOD device that is fluidly separated from the first region and the second region by said double walled section; performing an electrowetting operation to reconfigure the aqueous barrier to generate a first passage through a first limb of the double walled section, wherein the first passage fluidly connects the first region and the third region; performing an electrowetting operation to move the polar liquid droplet from the first region into the third region; performing an electrowetting operation to reconstitute the aqueous barrier by closing the first passage, wherein the polar liquid droplet remains within the third region; performing an electrowetting operation to reconfigure the aqueous barrier to generate a second passage through a second limb of the double walled section, wherein the second passage fluidly connects the third region and the second region; performing an electrowetting operation to move the polar liquid droplet from the third region into the second region; and performing an electrowetting operation to reconstitute the aqueous barrier by closing the second passage.

In an exemplary embodiment of the method of operating, the third region includes the second filler fluid.

In an exemplary embodiment of the method of operating, the method further includes performing an electrowetting operation to perform a droplet manipulation operation to the polar liquid droplet when the polar liquid droplet is in the third region.

In an exemplary embodiment of the method of operating, the droplet manipulation operation includes a washing operation.

In an exemplary embodiment of the method of operating, the aqueous barrier is generated prior to inputting the first and second filler fluids.

In an exemplary embodiment of the method of operating, the first filler fluid is inputted at a first end of the EWOD device, wherein the first filler fluid migrates toward a second end of the EWOD device opposite from the first end; the polar fluid source subsequently is dispensed and the aqueous barrier is generated in a region of the EWOD device to which the first filler fluid has not migrated, the method further including performing an electrowetting operation to position the aqueous barrier to divide the EWOD device into the first region containing the first filler fluid and the second region; and the second filler fluid is inputted into the second region after the aqueous barrier is positioned.

In an exemplary embodiment of the method of operating, at least one of the first filler fluid and the second filler fluid includes a surfactant.

In an exemplary embodiment of the method of operating, the polar liquid droplet includes a surfactant.

In an exemplary embodiment of the method of operating, the first filler fluid and/or the second filler fluid comprise an oil.

In an exemplary embodiment of the method of operating, the first filler fluid is different from the second filler fluid.

In an exemplary embodiment of the method of operating, the first filler fluid and the second filler fluid include a same base filler fluid, and first filler fluid is oxygenated and the second filler fluid is deoxygenated.

In an exemplary embodiment of the method of operating, the first filler fluid has a different melting and/or boiling temperature as compared to the second filler fluid.

In an exemplary embodiment of the method of operating, the first filler fluid and the second filler fluid include a same base filler fluid, and the first filler fluid includes a first surfactant and the second filler fluid includes a second and different surfactant.

In an exemplary embodiment of the method of operating, the method includes inputting a non-polar first filler fluid into the EWOD device; dispensing a polar liquid droplet into the EWOD device, wherein the polar liquid droplet is surrounded by the first filler fluid; performing an electrowetting operation to perform a droplet manipulation operation on the polar liquid droplet; extracting the first filler fluid from the EWOD device while actuating a portion of array elements of the EWOD device to maintain a position of the polar liquid droplet within the EWOD device; and inputting a non-polar second filler fluid into the EWOD device while actuating a portion of array elements of the EWOD device to maintain a position of the polar liquid droplet within the EWOD device.

In an exemplary embodiment of the method of operating, the first filler fluid is extracted by gradually displacing the first filler fluid with the second filler fluid.

Another aspect of the invention is a microfluidic system that includes an electro-wetting on dielectric (EWOD) device comprising an element array configured to receive a polar fluid source, one or more polar liquid droplets, and a plurality of filler fluids, the element array comprising a plurality of individual array elements; and a control system configured to control actuation voltages applied to the element array to perform manipulation operations to perform the method of operating an EWOD device according to any of the embodiments.

Another aspect of the invention is a non-transitory computer-readable medium storing program code which is executed by a processing device for controlling operation of an electro-wetting on dielectric (EWOD) device, the program code being executable by the processing device to perform the method of operating an EWOD device according to any of the embodiments.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

INDUSTRIAL APPLICABILITY

The described embodiments could be used to provide an enhanced AM-EWOD device. The AM-EWOD device could form a part of a lab-on-a-chip system. Such devices could be used for optical detection of biochemical or physiological materials, such as for cell detection and cell counting. Applications include healthcare diagnostic testing, material testing, chemical or biochemical material synthesis, proteomics, tools for research in life sciences and forensic science.

REFERENCE SIGNS LIST

32—reader
34—cartridge
35—external sensor module
36—AM-EWOD device
38—control electronics
40—storage device
44—lower substrate assembly
46—thin film electronics
48—array element electrodes
48A—array element electrode
48B—array element electrode
50—two-dimensional element array
51—array element
52—liquid droplet
54—top substrate
56—spacer
58—reference electrode
60—non-polar fluid
62—insulator layer
64—first hydrophobic coating
66—contact angle
68—second hydrophobic coating
70A—electrical load with droplet present
70B—electrical load without droplet present
72—array element circuit
74—integrated row driver
76—column driver
78—integrated sensor row addressing

80—column detection circuits
82—serial interface
84—voltage supply interface
86—connecting wires
88—actuation circuit
90—droplet sensing circuit
100—EWOD device
101—polar fluid source
102—first region
103—third region
104—second region
106—aqueous barrier
108—first filler fluid
110—second filler fluid
112—aqueous liquid droplets
114—passage between regions
118—first end of EWOD device
120—second end of EWOD device
126—double walled section of aqueous barrier
128—first passage between regions
130—second passage between regions

What is claimed is:

1. A microfluidic system comprising:

an electro-wetting on dielectric (EWOD) device comprising an element array configured to receive a polar fluid source, one or more polar liquid droplets, and a plurality of filler fluids, the element array comprising a plurality of individual array elements; and a control system configured to control actuation voltages applied to the element array to perform manipulation operations comprising:

dispensing a polar fluid source into the EWOD device;

performing an electrowetting operation to generate an aqueous barrier from the polar fluid source, wherein the aqueous barrier separates the EWOD device into a first region and a second region that are fluidly separated from each other by the aqueous barrier;

inputting a non-polar first filler fluid into the first region;

inputting a non-polar second filler fluid into the second region;

dispensing a polar liquid droplet into the first region;

transferring the polar liquid droplet from the first region to the second region by performing an electrowetting operation to reconfigure the aqueous barrier, and performing an electrowetting operation to move the polar liquid droplet from the first region to the second region through the reconfigured aqueous barrier; and performing an electrowetting operation to reconstitute the aqueous barrier to fluidly separate the first region from the second region.

2. The microfluidic system of claim 1, wherein the control system reconfiguring the aqueous barrier comprises performing an electrowetting operation to open a passage through the aqueous barrier, and the control system reconstituting the aqueous barrier comprises performing an electrowetting operation to close the passage.

3. The microfluidic system of claim 1, wherein the control system transferring the polar liquid droplet from the first region to the second region comprises:

performing an electrowetting operation to reconfigure the aqueous barrier to form a double walled section of the aqueous barrier enclosing a third region of the EWOD device that is fluidly separated from the first region and the second region by said double walled section;

performing an electrowetting operation to reconfigure the aqueous barrier to generate a first passage through a first limb of the double walled section, wherein the first passage fluidly connects the first region and the third region;

performing an electrowetting operation to move the polar liquid droplet from the first region into the third region;

performing an electrowetting operation to reconstitute the aqueous barrier by closing the first passage, wherein the polar liquid droplet remains within the third region;

performing an electrowetting operation to reconfigure the aqueous barrier to generate a second passage through a second limb of the double walled section, wherein the second passage fluidly connects the third region and the second region;

performing an electrowetting operation to move the polar liquid droplet from the third region into the second region; and performing an electrowetting operation to reconstitute the aqueous barrier by closing the second passage.

4. The microfluidic system of claim 3, wherein the third region includes the second filler fluid.

5. The microfluidic system of claim 3, wherein the control system further is configured to control actuation voltages applied to the element array to perform a droplet manipulation operation to the polar liquid droplet when the polar liquid droplet is in the third region.

6. The microfluidic system of claim 5, wherein the droplet manipulation operation includes a washing operation.

7. The microfluidic system of claim 1, wherein control system generates the aqueous barrier prior to inputting the first and second filler fluids.

8. The microfluidic system of claim 1, wherein the control system controls actuation voltages applied to the element array such that:

the first filler fluid is inputted at a first end of the EWOD device, wherein the first filler fluid migrates toward a second end of the EWOD device opposite from the first end;

the polar fluid source subsequently is dispensed and the aqueous barrier is generated in a region of the EWOD device to which the first filler fluid has not migrated, and the control system performs an electrowetting operation to position the aqueous barrier to divide the EWOD device into the first region containing the first filler fluid and the second region; and the second filler fluid is inputted into the second region after the aqueous barrier is positioned.

9. A non-transitory computer-readable medium storing program code which is executed by a processing device for controlling operation of an electro-wetting on dielectric (EWOD) device, the program code being executable by the processing device to perform the steps of:

dispensing a polar fluid source into the EWOD device;

performing an electrowetting operation to generate an aqueous barrier from the polar fluid source, wherein the aqueous barrier separates the EWOD device into a first region and a second region that are fluidly separated from each other by the aqueous barrier;

inputting a non-polar first filler fluid into the first region;

inputting a non-polar second filler fluid into the second region;

dispensing a polar liquid droplet into the first region;

transferring the polar liquid droplet from the first region to the second region by performing an electrowetting operation to reconfigure the aqueous barrier, and performing an electrowetting operation to move the polar liquid droplet from the first region to the second region through the reconfigured aqueous barrier; and performing an electrowetting operation to reconstitute the aqueous barrier to fluidly separate the first region from the second region.

10. The non-transitory computer-readable medium of claim 9, wherein reconfiguring the aqueous barrier comprises performing an electrowetting operation to open a passage through the aqueous barrier, and reconstituting the aqueous barrier comprises performing an electrowetting operation to close the passage.

11. The non-transitory computer-readable medium of claim 9, wherein transferring the polar liquid droplet from the first region to the second region comprises:

performing an electrowetting operation to reconfigure the aqueous barrier to form a double walled section of the aqueous barrier enclosing a third region of the EWOD device that is fluidly separated from the first region and the second region by said double walled section;

performing an electrowetting operation to reconfigure the aqueous barrier to generate a first passage through a first limb of the double walled section, wherein the first passage fluidly connects the first region and the third region;

performing an electrowetting operation to move the polar liquid droplet from the first region into the third region;

performing an electrowetting operation to reconstitute the aqueous barrier by closing the first passage, wherein the polar liquid droplet remains within the third region;

performing an electrowetting operation to reconfigure the aqueous barrier to generate a second passage through a second limb of the double walled section, wherein the second passage fluidly connects the third region and the second region;

performing an electrowetting operation to move the polar liquid droplet from the third region into the second region; and performing an electrowetting operation to reconstitute the aqueous barrier by closing the second passage.

12. The non-transitory computer-readable medium of claim 11, wherein the third region includes the second filler fluid.

13. The non-transitory computer-readable medium of claim 11, wherein the processing device further executes the program code to control actuation voltages applied to an element array to perform a droplet manipulation operation to the polar liquid droplet when the polar liquid droplet is in the third region.

14. The non-transitory computer-readable medium of claim 13, wherein the droplet manipulation operation includes a washing operation.

15. The non-transitory computer-readable medium of claim 9, wherein the aqueous barrier is generated prior to inputting the first and second filler fluids.

16. The non-transitory computer-readable medium of claim 9, wherein the processing device further executes the program code to control actuation voltages applied to an element array such that:

the first filler fluid is inputted at a first end of the EWOD device, wherein the first filler fluid migrates toward a second end of the EWOD device opposite from the first end;

the polar fluid source subsequently is dispensed and the aqueous barrier is generated in a region of the EWOD device to which the first filler fluid has not migrated, and the control system performs an electrowetting operation to position the aqueous barrier to divide the EWOD device into the first region containing the first filler fluid and the second region; and the second filler fluid is inputted into the second region after the aqueous barrier is positioned.

* * * * *